US008647191B2

(12) United States Patent
Shayesteh

(10) Patent No.: US 8,647,191 B2
(45) Date of Patent: Feb. 11, 2014

(54) RESONANT GAMING CHIP IDENTIFICATION SYSTEM AND METHOD

(75) Inventor: Hamid Shayesteh, Woodinville, WA (US)

(73) Assignee: Bally Gaming, Inc., Las Vegas, NV (US)

( * ) Notice: Subject to any disclaimer, the term of this patent is extended or adjusted under 35 U.S.C. 154(b) by 1676 days.

(21) Appl. No.: 11/838,148

(22) Filed: Aug. 13, 2007

(65) Prior Publication Data

US 2008/0076536 A1 Mar. 27, 2008

Related U.S. Application Data

(60) Provisional application No. 60/887,092, filed on Jan. 29, 2007, provisional application No. 60/847,331, filed on Sep. 26, 2006.

(51) Int. Cl.
*A63F 9/00* (2006.01)

(52) U.S. Cl.
USPC ..... 463/25

(58) Field of Classification Search
None
See application file for complete search history.

(56) References Cited

U.S. PATENT DOCUMENTS

| | | | | |
|---|---|---|---|---|
| 3,401,391 | A * | 9/1968 | Rice | 346/33 R |
| 3,740,742 | A | 6/1973 | Thompson et al. | 340/280 |
| 3,766,452 | A | 10/1973 | Burpee et al. | 317/262 R |
| 3,810,172 | A | 5/1974 | Burpee et al. | 343/5 PD |
| 4,023,167 | A | 5/1977 | Wahlstrom | 343/6.5 SS |
| 4,028,615 | A * | 6/1977 | Jansen et al. | 324/419 |
| 4,510,490 | A | 4/1985 | Anderson, III et al. | 340/572 |
| 4,531,117 | A | 7/1985 | Nourse et al. | 340/572 |
| 4,577,152 | A * | 3/1986 | Macovski | 324/309 |
| 4,656,463 | A | 4/1987 | Anders et al. | 340/572 |
| 4,660,025 | A | 4/1987 | Humphrey | 340/572 |
| 4,746,830 | A | 5/1988 | Holland | 310/313 D |
| 4,814,589 | A | 3/1989 | Storch et al. | 235/375 |
| 4,859,991 | A | 8/1989 | Watkins et al. | 340/572 |
| 4,870,391 | A | 9/1989 | Cooper | 340/572 |
| 4,920,335 | A | 4/1990 | Andrews | 340/572 |
| 4,926,996 | A | 5/1990 | Eglise et al. | 194/212 |
| 5,103,234 | A | 4/1992 | Watkins et al. | 343/742 |

(Continued)

FOREIGN PATENT DOCUMENTS

| | | |
|---|---|---|
| EP | 0 790 848 B1 | 8/1997 |
| WO | 96/03188 A1 | 2/1996 |

(Continued)

OTHER PUBLICATIONS

Palermo, V. "Near-field magnetic comms emerges," EE Times Design, Oct. 31, 2003.

(Continued)

*Primary Examiner* — Seng H Lim
(74) *Attorney, Agent, or Firm* — Frank Abramonte; Fearon Brown; Marvin Hein

(57) ABSTRACT

A system and method for a gaming chip identification system are disclosed. Briefly described, one embodiment comprises a plurality of gaming chips, each gaming chip operable to emit a respective unique electromagnetic signature in response to incident non-optical electromagnetic radiation, a computer-readable medium that stores information indicative of the electromagnetic signatures of at least a number of the plurality of gaming chips, and a processor-based system configured to verify that the electromagnetic signature from an interrogated gaming chip in an interrogation zone is a member of the plurality of gaming chips.

24 Claims, 19 Drawing Sheets

(56) References Cited

U.S. PATENT DOCUMENTS

| | | | | |
|---|---|---|---|---|
| 5,166,502 | A | 11/1992 | Rendleman et al. | 235/492 |
| 5,175,499 | A * | 12/1992 | Davies | 324/300 |
| 5,283,422 | A | 2/1994 | Storch et al. | 235/375 |
| 5,321,241 | A | 6/1994 | Craine | 235/380 |
| 5,361,885 | A | 11/1994 | Modler | 194/214 |
| 5,406,264 | A | 4/1995 | Plonsky et al. | 340/572 |
| 5,538,803 | A | 7/1996 | Gambino et al. | 428/694 TM |
| 5,557,280 | A | 9/1996 | Marsh et al. | 342/44 |
| 5,581,257 | A | 12/1996 | Greene et al. | 342/51 |
| 5,625,341 | A | 4/1997 | Giles et al. | 340/572 |
| 5,651,548 | A | 7/1997 | French et al. | 273/309 |
| 5,676,376 | A | 10/1997 | Valley | 273/288 |
| 5,699,066 | A | 12/1997 | Marsh et al. | 342/44 |
| 5,707,287 | A | 1/1998 | McCrea, Jr. | 463/27 |
| 5,735,742 | A | 4/1998 | French | 463/25 |
| 5,742,656 | A | 4/1998 | Mikulak et al. | 377/7 |
| 5,754,110 | A | 5/1998 | Appalucci et al. | 340/572 |
| 5,755,618 | A | 5/1998 | Mothwurf | 453/17 |
| 5,757,876 | A | 5/1998 | Dam et al. | 377/7 |
| 5,770,533 | A | 6/1998 | Franchi | 463/42 |
| 5,785,321 | A | 7/1998 | van Putten et al. | 273/309 |
| 5,812,065 | A | 9/1998 | Schrott et al. | 340/825.54 |
| 5,831,532 | A | 11/1998 | Gambino et al. | 340/572 |
| 5,847,650 | A | 12/1998 | Zhou et al. | 340/572 |
| 5,895,321 | A | 4/1999 | Gassies et al. | 463/29 |
| 5,911,626 | A | 6/1999 | McCrea, Jr. | 463/27 |
| 5,919,090 | A | 7/1999 | Mothwurf | 463/25 |
| 5,936,527 | A | 8/1999 | Isaacman et al. | 340/572.1 |
| 5,941,769 | A | 8/1999 | Order | 463/12 |
| 6,021,949 | A | 2/2000 | Boiron | 235/492 |
| 6,029,891 | A | 2/2000 | Freeman et al. | 235/380 |
| 6,093,103 | A | 7/2000 | McCrea, Jr. | 463/27 |
| 6,117,012 | A | 9/2000 | McCrea, Jr. | 463/27 |
| 6,144,300 | A | 11/2000 | Dames | 340/572.2 |
| 6,165,069 | A | 12/2000 | Sines et al. | 463/12 |
| 6,186,895 | B1 * | 2/2001 | Oliver | 463/25 |
| 6,264,109 | B1 | 7/2001 | Chapet et al. | 235/492 |
| 6,299,534 | B1 | 10/2001 | Breeding et al. | 463/25 |
| 6,307,473 | B1 | 10/2001 | Zampini et al. | 340/572.1 |
| 6,346,044 | B1 | 2/2002 | McCrea, Jr. | 463/27 |
| 6,371,379 | B1 * | 4/2002 | Dames et al. | 235/493 |
| 6,425,817 | B1 | 7/2002 | Momemy | 453/17 |
| 6,437,692 | B1 | 8/2002 | Petite et al. | 340/540 |
| 6,464,584 | B2 * | 10/2002 | Oliver | 463/25 |
| 6,486,655 | B1 | 11/2002 | Crossfield | 324/207.17 |
| 6,581,747 | B1 | 6/2003 | Charlier et al. | 194/214 |
| 6,629,591 | B1 | 10/2003 | Griswold et al. | 194/205 |
| 6,629,889 | B2 | 10/2003 | Mothwurf | 463/25 |
| 6,659,875 | B2 | 12/2003 | Purton | 463/47 |
| 6,685,564 | B2 * | 2/2004 | Oliver | 463/25 |
| 6,690,156 | B1 * | 2/2004 | Weiner et al. | 324/207.17 |
| 6,702,291 | B2 | 3/2004 | Grebler et al. | 273/292 |
| 6,726,099 | B2 | 4/2004 | Becker et al. | 235/380 |
| 6,735,183 | B2 | 5/2004 | O'Toole et al. | 370/311 |
| 6,812,824 | B1 | 11/2004 | Goldinger et al. | 340/10.1 |
| 6,925,701 | B2 | 8/2005 | Eckstein et al. | 29/602.1 |
| 6,947,513 | B2 | 9/2005 | O'Toole et al. | 375/374 |
| 6,970,141 | B2 | 11/2005 | Copeland et al. | 343/866 |
| 7,005,985 | B1 | 2/2006 | Steeves | 340/572.1 |
| 7,009,496 | B2 | 3/2006 | Arneson et al. | 340/10.2 |
| 7,028,910 | B2 | 4/2006 | Reignoux et al. | 235/492 |
| 7,040,139 | B2 | 5/2006 | Sunshine | 73/23.2 |
| 7,075,440 | B2 * | 7/2006 | Fabian et al. | 340/572.6 |
| 7,077,332 | B2 | 7/2006 | Verschuur et al. | 235/492 |
| 7,119,685 | B2 | 10/2006 | Eckstein et al. | 340/571 |
| 7,147,558 | B2 | 12/2006 | Giobbi | 463/25 |
| 7,172,197 | B2 | 2/2007 | Wilson et al. | 273/288 |
| 7,187,289 | B2 | 3/2007 | Eckstein et al. | 340/572.1 |
| 7,271,727 | B2 | 9/2007 | Steeves | 340/572.7 |
| 7,351,145 | B1 * | 4/2008 | Ornstein et al. | 463/25 |
| 7,404,765 | B2 * | 7/2008 | Soltys et al. | 463/25 |
| 7,422,522 | B2 | 9/2008 | Fujimoto et al. | 463/16 |
| 7,525,283 | B2 | 4/2009 | Cheng et al. | 320/108 |
| 7,559,839 | B2 * | 7/2009 | Bahar | 463/25 |
| 7,575,234 | B2 * | 8/2009 | Soltys et al. | 273/149 R |
| 7,753,779 | B2 | 7/2010 | Shayesteh | 463/25 |
| 7,753,781 | B2 * | 7/2010 | Storch | 463/25 |
| 7,780,526 | B2 | 8/2010 | Nguyen et al. | 463/29 |
| 7,846,020 | B2 * | 12/2010 | Walker et al. | 463/29 |
| 7,862,425 | B2 | 1/2011 | Cavagna | 463/25 |
| 2001/0016515 | A1 * | 8/2001 | Oliver | 463/25 |
| 2002/0084587 | A1 | 7/2002 | Bennett et al. | 273/309 |
| 2002/0111210 | A1 | 8/2002 | Luciano, Jr. et al. | 463/29 |
| 2002/0142846 | A1 | 10/2002 | Paulsen | 463/43 |
| 2002/0147042 | A1 | 10/2002 | Vuong et al. | 463/40 |
| 2003/0022714 | A1 | 1/2003 | Oliver | 463/25 |
| 2003/0042679 | A1 | 3/2003 | Snow | 273/292 |
| 2003/0045354 | A1 | 3/2003 | Giobbi | 463/40 |
| 2003/0064798 | A1 | 4/2003 | Grauzer et al. | 463/29 |
| 2003/0195037 | A1 | 10/2003 | Vuong et al. | 463/29 |
| 2004/0087375 | A1 | 5/2004 | Gelinotte | 463/47 |
| 2004/0111338 | A1 | 6/2004 | Bandy et al. | 705/28 |
| 2004/0127277 | A1 | 7/2004 | Walker et al. | 463/16 |
| 2004/0142743 | A1 * | 7/2004 | Oliver | 463/25 |
| 2004/0207156 | A1 | 10/2004 | Soltys et al. | 273/292 |
| 2004/0219982 | A1 | 11/2004 | Khoo et al. | 463/42 |
| 2004/0229682 | A1 | 11/2004 | Gelinotte | 463/25 |
| 2005/0026680 | A1 | 2/2005 | Gururajan | 463/25 |
| 2005/0027604 | A1 | 2/2005 | Bandy et al. | 705/22 |
| 2005/0051965 | A1 | 3/2005 | Gururajan | 273/292 |
| 2005/0054408 | A1 | 3/2005 | Steil et al. | 463/11 |
| 2005/0116020 | A1 | 6/2005 | Smolucha et al. | 235/375 |
| 2005/0156318 | A1 | 7/2005 | Douglas | 257/761 |
| 2005/0227760 | A1 | 10/2005 | Vlazny et al. | 463/28 |
| 2005/0266919 | A1 | 12/2005 | Rowe et al. | 463/25 |
| 2005/0288083 | A1 | 12/2005 | Downs, III | 463/11 |
| 2005/0288084 | A1 | 12/2005 | Schubert | 463/11 |
| 2005/0288085 | A1 | 12/2005 | Schubert et al. | 463/11 |
| 2006/0019745 | A1 | 1/2006 | Benbrahim | 463/29 |
| 2006/0066444 | A1 | 3/2006 | Steeves | 340/10.5 |
| 2006/0205508 | A1 | 9/2006 | Green | 463/40 |
| 2007/0057469 | A1 | 3/2007 | Grauzer et al. | 273/309 |
| 2007/0060307 | A1 | 3/2007 | Mathis et al. | 463/25 |
| 2007/0111775 | A1 | 5/2007 | Yoseloff | 463/16 |
| 2007/0293303 | A1 | 12/2007 | Shayesteh | 463/25 |
| 2008/0076536 | A1 | 3/2008 | Shayesteh | 463/25 |
| 2009/0005176 | A1 | 1/2009 | Morrow et al. | 463/43 |
| 2009/0093293 | A1 * | 4/2009 | Koyama et al. | 463/17 |
| 2009/0104981 | A1 * | 4/2009 | Koyama | 463/25 |
| 2009/0115133 | A1 | 5/2009 | Kelly et al. | 273/274 |
| 2009/0117994 | A1 | 5/2009 | Kelly et al. | 463/25 |
| 2009/0118001 | A1 | 5/2009 | Kelly et al. | 463/29 |
| 2009/0118005 | A1 | 5/2009 | Kelly et al. | 463/31 |
| 2009/0118006 | A1 | 5/2009 | Kelly et al. | 463/31 |
| 2010/0130280 | A1 | 5/2010 | Arezina et al. | 463/20 |

FOREIGN PATENT DOCUMENTS

| | | | |
|---|---|---|---|
| WO | 96/36253 | A1 | 11/1996 |
| WO | 99/43403 | A1 | 9/1999 |
| WO | 00/22585 | A2 | 4/2000 |

OTHER PUBLICATIONS

MagTek, "Port Powered Swipe Reader," Technical Reference Manual, Manual Part No. 99875094 Rev 12, Jun. 2003, 20 pages.

Burke, A., "Tracking the Tables," reprinted from *International Gaming & Wagering Business*, Aug. 2003, 4 pages.

*Gambling Magazine*, "Gaming Company Takes RFID to the Casino," Dec. 27, 2004, accessed Aug. 25, 2006, URL = http:/www.gamblingmagazine.com/managearticle.asp?C=290&A=13186, 4 pages.

Mikohn, "Mikohn Tablelink—The Industry's Premier Table Tracking Solution Delivers Improvements Straight to the Bottom Line," 2 pages, before Jan. 1, 2004.

Mikohn, "Tablelink™ , The New Standard in Table Games," before Jan. 1, 2004, 14 pages.

Bulavsky, J., "Tracking the Tables," *Casino Journal*, May 2004, pp. 44-47, accessed Dec. 21, 2005, URL = http://www.ascendgaming.com/cj/vendors_manufacturers_table/Trackin916200411141AM.htm, 5 pages.

* cited by examiner

RESONANT GAMING CHIP IDENTIFICATION SYSTEM AND METHOD

CROSS-REFERENCE TO RELATED APPLICATION

This application claims the benefit under 35 U.S.C. §119 (e) of U.S. Provisional Patent Application No. 60/847,331 filed Sep. 26, 2006; and U.S. Provisional Patent Application No. 60/887,092 filed Jan. 29, 2007; where these (two) provisional applications are incorporated herein by reference in their entireties.

BACKGROUND OF THE INVENTION

1. Field of the Invention

This description generally relates to the field of table gaming and, more particularly, to a system and method of identifying gaming chips.

2. Description of the Related Art

Gaming chips, or tokens, are used at various types of gaming tables as a substitute for currency. Automated identification of the denomination of gaming chips and/or identity of individual gaming chips is becoming important to gaming establishments, such as casinos, for a variety of reasons. For example, automated systems which identify the presence of valid gaming chips simplify accounting and lower labor costs. Such systems may also make it more difficult for individuals to use counterfeit gaming chips or gaming chips from other gaming establishments. Further, such automated systems may deter theft of gaming chips, for example by monitoring exit points and locations where large quantities of chips are handled, such as at the cashier's cage, the counting room, or even at the gaming tables.

A recent development in the gaming industry is the automated tracking of individual player gaming activities. Tracking an individual player's gaming history allows the gaming establishment to identify and/or reward favored customers with complimentary benefits, commonly referred to as "comps". Particularly lucky players and/or cheaters may be identified using such tracking systems.

When the gaming histories of many players are aggregated, the information may be used by the gaming establishment to better predict revenues, allocate resources, control costs, and/or reward or comp valued customers. For example, a gaming establishment may trend aggregated gaming histories to better match the types of offered games to its customers.

An exemplary system which allows remote identification of gaming chips is disclosed in French et al., U.S. Pat. No. 5,651,548, which discloses electronically-identifiable gaming chips which have been tagged with a radio frequency transmitter that transmits various information about the gaming chip, such as an individual identification number and/or the value of the chip. The gaming chip employs an electronic transmitter chip, an antenna, and an optional battery. In response to receiving an interrogation signal from a transmitter, the gaming chip communicates a radio signal to a receiving antenna. This system and method of identifying gaming chips is an application of the well known and commonly available radio frequency identification (RFID) technologies. However, such RFID systems which identify individual gaming chips are relatively expensive in that each gaming chip must have the RFID circuit embedded therein. RFID circuits currently cost between $0.50 and $1.50 in large quantities, a price that makes such commercially impractical for most casinos. Power required to transmit RFID signals from the gaming chip may also be an issue since RFID circuits are processor-based systems that use a computer-readable memory medium to store the identification information.

Accordingly, it is desirable to be able to remotely identify gaming chips in a less expensive manner.

SUMMARY OF THE INVENTION

In one aspect, a system to facilitate wagering includes at least one transmitter operable to emit non-optical electromagnetic energy via at least one antenna; at least one receiver operable to receive a resonant response from gaming chips within a range of the emitted non-optical electromagnetic energy via at least one antenna; a computer-readable medium that stores information indicative of at least one resonant response of a valid set of gaming chips; and at least one processor programmed to determine whether a gaming chip is from the valid set based at least in part on a received resonant response. The computer-readable medium may store information indicative of a first resonant response of a first subset of the valid set of gaming chips and a second resonant response of a second subset of the gaming chips, the gaming chips of the first subset bearing indicia of a first denomination and the gaming chips of the second subset bearing indicia of a second denomination, and wherein the at least one processor is further programmed to determine a denomination of the gaming chip based at least in part on the received resonant responses. The computer-readable medium may store information indicative of a unique resonant response of each of the gaming chips in the valid set of gaming chips, and wherein the at least one processor is further programmed to uniquely identify the gaming chips from all other gaming chips in the set of valid gaming chips, based at least in part on the received resonant responses. The system may further include a first plurality of gaming chips of a first denomination, each of the gaming chips in the first plurality of gaming chips configured to emit a first resonant response in response to incident non-optical electromagnetic radiation, and a second plurality of gaming chips of a second denomination, each of the gaming chips in the second plurality of gaming chips configured to emit a second resonant response in response to incident non-optical electromagnetic radiation, the second resonant response discernibly different from the first resonant response.

In another aspect, a method of uniquely identifying a plurality of gaming chips includes emitting non-optical electromagnetic energy via at least one antenna; receiving a number of resonant responses from a number of gaming chips without a memory, the gaming chips within a range of the emitted non-optical electromagnetic energy via at least one antenna; and determining at least one respective characteristic of each of a number of the gaming chips based on the received resonant responses.

In yet another aspect, a set of gaming chips includes a first plurality of gaming chips each bearing indicia of a first denomination, each of the first plurality of gaming chips having a first resonant marker that resonates in a first resonant frequency band in response to absorbing electromagnetic energy characterized by a selected frequency, and that emits non-optical electromagnetic energy with a first electromagnetic signature; and a second plurality of gaming chips each bearing indicia of a second denomination, different from the first denomination, and each of the second plurality of gaming chips having a second resonant marker that resonates in a second resonant frequency band in response to absorbing the electromagnetic energy characterized by the selected frequency, and that emits non-optical electromagnetic energy with a second electromagnetic signature, wherein the first unique electromagnetic signature and the second unique electromagnetic signature are discernibly different. The set of gaming chips may further include a third plurality of gaming chips each bearing indicia of a third denomination, each of the third plurality of gaming chips having a third resonant marker that resonates in a third resonant frequency band in response to absorbing electromagnetic energy characterized by a selected frequency, and that emits non-optical electromagnetic energy with a third electromagnetic signature, different from the first and the second electromagnetic signatures. The first resonant marker and the second resonant marker may comprise a magnetic material that resonates in the respective first and the second resonant frequency bands when the electromagnetic energy characterized by the selected frequency is absorbed. The first resonant marker may comprise a first equivalent resistive, inductive, and capacitive (RLC) circuit, wherein the second resonant marker is characterized by a second equivalent RLC circuit, and wherein the first equivalent RLC circuit and the second equivalent RLC circuit resonate in the respective ones of the first and the second resonant frequency bands when the electromagnetic energy characterized by the selected frequency is absorbed. The first resonant markers of the gaming chips in the first plurality of gaming chips may have a first shape, and the second resonant markers of the gaming chips in the second plurality of gaming chips may have a second shape different from the first shape. The first resonant markers of the gaming chips in the first plurality of gaming chips may have at least a first dimension of a first size, and the second resonant markers of the second plurality of gaming chips may have at least the first dimension of a second size different from the first size. The first resonant marker of the gaming chips in the first plurality of gaming chips may consist of a first material, and the second resonant markers of the gaming chips in the second plurality of gaming chips may consist of a second material, different from the first material. The resonant markers of the first pluralities may be identical within a manufacturing tolerance and unique outside of the manufacturing tolerance such that each resonant marker in the first plurality has a common or shared resonant response at high level or rough grain and yet has a unique resonant response at a low level or fine grain.

In yet another aspect, a system to form valid sets of gaming chips includes at least one transmitter operable to emit non-optical electromagnetic energy via at least one antenna; at least one receiver operable to receive a resonant response from any resonant markers within a range of the emitted non-optical electromagnetic energy via at least one antenna; a computer-readable medium operable to store information indicative of resonant responses from a plurality of resonant markers; and at least one processor programmed to determine whether received resonant responses from the resonant markers are discernibly distinct from the resonant responses of resonant markers for which information indicative of the resonant response has previously stored in the computer-readable medium.

In yet another aspect, a method of forming valid sets of gaming chips includes emitting non-optical electromagnetic energy via at least one antenna; receiving a returning non-optical electromagnetic resonant response from a resonant marker in response to the emitted non-optical electromagnetic energy; and determining whether the received resonant response is discernibly distinct from all resonant responses from respective ones of a number of resonant markers for which information indicative of the respective resonant responses has previously been stored in a computer-readable medium. The method may further include storing information indicative of the received resonant response in the computer-readable medium if the received resonant response is discernibly distinct from the resonant responses for which information indicative of the resonant response has previously been stored in the computer-readable medium. The method may further include not storing information indicative of the received resonant response in the computer-readable medium if the received resonant response is not discernibly distinct from the resonant responses for which information indicative of the resonant response has previously been stored in the computer-readable medium. The method may further include applying an indicia on at least one of the resonant marker or the respective gaming chip for any resonant marker that emits a resonant response that is not discernibly distinct from the resonant responses for which information indicative of the resonant response has previously been stored in the computer-readable medium where the indicia is indicative of the result of the determination. The method may further include assigning a respective unique identifier to each of the gaming chips having a resonant marker that emits a resonant response that is discernibly distinct from the resonant responses for which information indicative of the resonant response has previously been stored in the computer-readable medium; and associating the unique identifier with the information indicative of the resonant response in the computer-readable medium. The method may further include discarding any resonant marker that emits a resonant response that is not discernibly distinct from the resonant responses for which information indicative of the resonant response has previously been stored in the computer-readable medium. The method may further include discarding any one of the gaming chips having a resonant marker that emits a resonant response that is not discernibly distinct from the resonant responses for which information indicative of the resonant response has previously been stored in the computer-readable medium. The method may further include physically coupling the resonant marker to a gaming chip or replacing the resonant marker in the gaming chip with a new resonant marker if the received resonant response from the resonant marker is not discernibly distinct from all resonant responses from a respective ones of a number of resonant markers for which information indicative of the respective resonant responses has previously been stored in a computer-readable medium.

In yet another aspect, a computer-readable medium stores instructions that cause a processor to form valid sets of gaming chips, by determining whether a received resonant response is discernibly distinct from all resonant responses from respective ones of a number of resonant markers for which information indicative of the respective resonant responses has previously been stored in a computer-readable medium; and storing information indicative of the received resonant response in the computer-readable medium if the received resonant response is discernibly distinct from the resonant responses for which information indicative of the resonant response has previously been stored in the computer-readable medium.

BRIEF DESCRIPTION OF THE DRAWINGS

In the drawings, identical reference numbers identify similar elements or acts. The sizes and relative positions of elements in the drawings are not necessarily drawn to scale. For example, the shapes of various elements and angles are not drawn to scale and some of these elements are arbitrarily enlarged and positioned to improve drawing legibility. Further, the particular shapes of the elements, as drawn, are not intended to convey any information regarding the actual shape of the particular elements and have been solely selected for ease of recognition in the drawings.

DETAILED DESCRIPTION OF THE INVENTION

Figure 1:
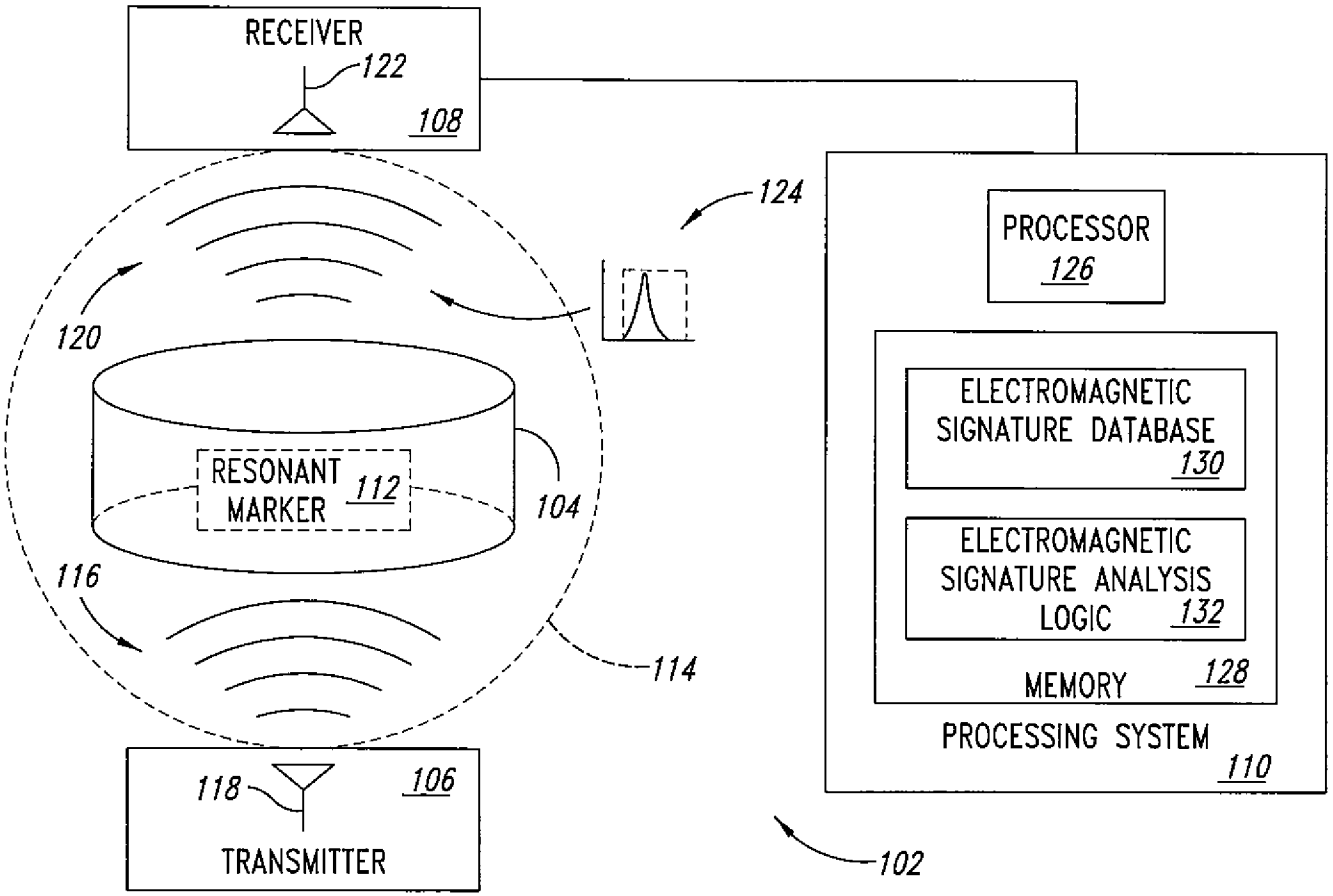
FIG. 1 is a block diagram of a gaming chip identification system and gaming chip, according to one illustrated embodiment.

In the following description, certain specific details are set forth in order to provide a thorough understanding of various embodiments of the invention. However, one skilled in the art will understand that the invention may be practiced without these details. In other instances, well-known structures associated with computers, computer networks, communications interfaces, sensors and/or transducers, antennas, transmitters, receivers or transceivers may not be shown or described in detail to avoid unnecessarily obscuring the description.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

The headings provided herein are for convenience only and do not interpret the scope or meaning of the claimed invention.

This description generally relates to a gaming environment that employs gaming chips or tokens as a currency medium. Other devices or systems associated with gaming, such as those used to automate, enhance, monitor, and/or detect some aspect of gaming establishment management or operation, may interface or otherwise communicate with the gaming chip identification system. Further, the gaming chip identification system itself may be used as a sub-element in such devices or systems. This description also relates to a manufacturing environment for creating or forming valid sets of gaming chips.

For purposes of clarity and brevity, the gaming chip identification system described and illustrated herein may reference certain games such as blackjack or craps. However, it is understood and appreciated that the gaming chip identification system is generally applicable to a variety of casino-type games, gaming tables, and/or operations. Further, the gaming chip identification system may be generally applicable to other recreational games played without monetary wagering, that employ chips or the like. In addition, it is understood that the gaming chip identification system may be capable of identifying other token-like objects that do not necessarily correspond to a standard or conventional gaming chip, for example chips that are larger or smaller, shaped differently, and/or made from materials other than traditional gaming chip materials.

Brief Overview of the Gaming Chip Identification System

FIG. 1 is a block diagram showing an embodiment of a system for facilitating wagering. The illustrated exemplary embodiment of a gaming wagering system 100 comprises a gaming chip identification system 102, a plurality of gaming chips 104. The gaming chip identification system 102 comprises a transmitter 106, a receiver 108, and a processing system 110. Processing system 110 may be any suitable processor-based system. Other embodiments may include, but are not limited to, a gaming chip testing system, a gaming chip manufacturing system, or the like.

In the various embodiments, each of the gaming chips 104 carries a respective resonant marker 112, described in detail below. The resonant markers 112 may be carried partially or wholly encased in an outer periphery of the gaming chip 104, or may be carried partially or wholly on the outer periphery thereof. Encasing the resonant markers 112 with the outer periphery may advantageously protect the resonant marker 112 from damage due to wear or elements. In contrast, locating the resonant marker 112 in or extending from the outer periphery may improve detectability of the response, and hence increase the effective range of the resonance marker 112. The resonant marker 112 may be affixed to the outer periphery using a suitable adhesive, a label, or other suitable means.

For convenience, the region of space around the transmitter 106 and the receiver 108 wherein a gaming chip 104 is detectable is referred to hereinafter as the interrogation zone 114.

The transmitter 106 is operable to emit non-optical electromagnetic energy 116 via an antenna 118. The size or volume of the interrogation zone 114 may be a function of the antenna shape and power of the transmitter. The receiver 108 is operable to detect the returned electromagnetic energy 120 via an antenna 122.

When a gaming chip 104 having a resonant marker 112 is in the interrogation zone 114, the returned electromagnetic energy 120 that is detected by receiver 108 will be modulated or otherwise transformed by the resonant marker 112. That is, the returned electromagnetic energy 120 will be discernibly different from the electromagnetic energy 116 emitted by the transmitter 106.

Generally, the returned electromagnetic energy 120 may be characterized by a frequency envelope corresponding to a curve of frequency components having measurable amplitudes at discernable frequencies. As will be described in greater detail below, the returned electromagnetic energy 120 will be modulated by one or more resonant markers 112 when in the interrogation zone 114. The modulated returned electromagnetic energy 120 may also be characterized by a frequency envelope corresponding to a curve of frequency components having measurable amplitudes at discernable frequencies. This modulated frequency is referred to hereinafter as an electromagnetic signature 124.

An electromagnetic signature 124 has at least one discernable distinctive characteristics in one of the frequencies and/or amplitudes thereof. In some embodiments, each gaming chip 104 of a like denomination (e.g., $1, $5, $10, $25, $100) has a like discernable distinctive characteristic. For example, all gaming chips 104 of a first denomination ($1) or subset have a first discernable distinctive characteristic, while all gaming chips 104 of a second denomination (e.g., $5) or subset have a second discernable distinctive characteristic, different from the first discernable distinctive characteristic. In some embodiments, each of the gaming chips 104 of a like denomination includes a further discernable distinctive characteristic which uniquely identifies the gaming chip 104 within the particular denomination or subset. Thus, one discernable distinctive characteristic identifies a gaming chip 104 as belonging to a particular denomination or subset, while another distinctive characteristic uniquely identifies the gaming chip 104 within the particular denomination or subset. In yet other embodiments, each gaming chip 104 has at least one resonant marker 112 that has a unique electromagnetic signature 124 when compared to the resonant markers 112 of all other gaming chips in a valid set of gaming chips.

The receiver 108, in one exemplary embodiment, is communicatively coupled to processing system 110. In one embodiment, the processing system 110 comprises a processor 126 and a memory 128. The electromagnetic signature database 130 and the electromagnetic signature analysis logic 132 reside in memory 128. The processing system 110 analyzes information corresponding to the returned electromagnetic energy 120 to identify the unique characteristics of the electromagnetic signature 124.

The electromagnetic signature database 130 includes at least a plurality of entries having information corresponding to the electromagnetic signatures 124 of the plurality of resonant markers 112 residing in the gaming chips 104. In some embodiments, a unique identifier (FIG. 10) associates the electromagnetic signature information corresponding to the electromagnetic signatures 124 with the gaming chip 104 having the resonant marker 112 residing therein. That is, in some embodiments each resonant marker 112 modulates the returned electromagnetic energy 120 in a unique manner, such that the gaming chip(s) residing in the interrogation zone 114 may be identified by a respective unique non-optical electromagnetic signature 124.

For convenience, the processing system 110 and associated components are illustrated separately from the transmitter 106 and the receiver 108. The processing system 110, associated components, transmitter 106, and/or receiver 108 may reside in alternative convenient locations, such as, but not limited to, together in a common enclosure, as components of other systems, or as a stand-alone dedicated unit. Other components, not illustrated or discussed herein, may be included in alternative embodiments. Any such alternative embodiments of a gaming chip identification system 102 are intended to be within the scope of this disclosure.

Resonant Markers

The resonant markers 112 may be broadly classified into three categories, a magnetic type resonant marker, a resistor, inductor, capacitor (RLC) circuit type resonant marker, and a cavity type resonant maker. All three of the types of resonant markers 112 absorb a portion of the emitted electromagnetic energy 116 transmitted by the transmitter 106. In the various embodiments described in greater detail herein below, the resonant markers 112 release a portion of the absorbed electromagnetic energy in a modulated or modified form, thereby causing the above-described modulation in the returned electromagnetic energy 120 that is detectable by the receiver 108. That is, at least one resonant marker 112 associated with each gaming chip 104 is operable to emit a respective electromagnetic signature 124 in response to incident electromagnetic energy 116. As noted above, the electromagnetic signature 124 may be distinctive between denominations or subsets of gaming chips 104, or may be unique within a denomination or subset or may be unique across an entire a set of valid gaming chips 104.

It is appreciated that the magnetic, RLC, and cavity type resonant markers 112 are different from radio frequency identification (RFID) type markers. RFID markers employ a transmitter and antenna to transmit a radio frequency signal in response to a detected interrogation signal transmitted by an RFID transmitter. Typically, the generated output radio frequency signal from the RFID transmitter has identification information encoded into the output radio frequency signal. Since the identification information used to generate the output radio frequency signal resides in a memory of the RFID type marker, the identification information is a digitally based identifier. In contrast, the resonant markers 112 used by the various embodiments of the gaming chip identification system 102 do not employ memories or RFID transmitters and, accordingly, they do not emit RFID type output signals.

Magnetic Resonant Markers

The first exemplary type of resonant marker 112 used by some embodiments of the gaming chip identification system 102 employs one or more magnetic materials. As incident non-optical electromagnetic energy is absorbed by the magnetic material of the magnetic type resonant marker 112, the magnetic domains of the magnetic material grow and/or rotate.

This absorption of electromagnetic energy causes a detectable modulation in the returned electromagnetic energy 120 that may be detected by receiver 108. That is, the emitted electromagnetic energy 116 is discernibly different from the returned electromagnetic energy 120. Some embodiments of the gaming chip identification system 102 are operable to compare the emitted electromagnetic energy 116 and the returned electromagnetic energy 120 to determine the respective electromagnetic signature(s) 124.

When there is no longer incident non-optional electromagnetic energy 116, such as when the transmitter 106 ceases transmission, the above-described magnetic domains may return to their original orientation, thereby releasing electromagnetic energy. This release of electromagnetic energy from the magnetic domains becomes the returned electromagnetic energy 120, which is detectable by selected embodiments of the receiver 108. Accordingly, some embodiments of the gaming chip identification system 102 are operable to determine the respective electromagnetic signature(s) 124 from the returned, non-optical electromagnetic energy 120 (after the transmitter 106 ceases transmission).

When the transmitter 106 emits electromagnetic energy 116 at a selected frequency or frequency range, the magnetic domains of the magnetic type resonant marker 112 are forced to periodically realign. Accordingly, electromagnetic energy is released each time the magnetic domains realign. That is, the frequency of the emitted electromagnetic energy 116 induces a detectable resonance in the returned electromagnetic energy 120 released by the magnetic type resonant marker 112. As noted above, this release of the returned electromagnetic energy 120 from the magnetic domains is detectable by receiver 108.

A magnetic type resonant marker 112 may be comprised of a ferromagnetic material and/or a magnetorestrictive material. U.S. Pat. No. 4,510,490 to Anderson, III et al. describes various processes whereby magnetic type markers release detectable magnetic energy at preselected frequencies to provide a detectable magnetic marker. U.S. Pat. No. 5,406,264 to Plonsky et al. describes a gaming chip with a detectable magnetic marker. However, Anderson, III et al. and Plonsky et al. are limited to detecting only the presence of magnetic type markers when the markers are exposed to emitted electromagnetic energy of a selected frequency or frequency range. Neither Anderson, III et al. or Plonsky et al. discloses identifying individual gaming chips 104 by the respective electromagnetic signature 124 generated by the magnetic type resonant marker 112 residing therein when the gaming chips 104 are exposed to the same selected frequency or frequency range of emitted electromagnetic energy 116.

During the manufacturing process, some variation between individual magnetic type resonant markers 112 in a denomination, subset, or set of substantially similar magnetic type markers 112 will inevitably occur. For example, manufacturing tolerances may be set so as to ensure that individual magnetic type resonant markers 112 of the group have substantially similar dimensions. However, such manufacturing tolerances inherently allow slightly different physical dimensions between magnetic type resonant markers 112 as they are manufactured. For example, physical dimensions may vary outside the ability to control such based on the particular manufacturing tolerances (e.g., below $1/100^{th}$ of an inch), providing for a unique characteristic in the respective electromagnetic signatures. As another example, the material composition of individual magnetic type resonant markers 112 of the group may vary slightly from marker to marker due to inherent material composition tolerances. For example, the composition of the material may vary outside the ability to control such based on the particular manufacturing tolerances (e.g., below 1 part in 1000), providing for a unique characteristic in the respective electromagnetic signatures. If the magnetic type resonant markers 112 are shaped in a particular manner during the manufacturing process, slight variations in shape will occur from marker to marker due to inherent fabrication tolerances. For example, a geometric shape may vary outside the ability to control such based on the particular manufacturing tolerances (e.g., disk slightly out of round), providing for a unique characteristic in the respective electromagnetic signatures. It is appreciated that in any manufacturing process, such variations in dimensions, material compositions, and/or shape will likely occur. So long as such variations are within design tolerances, a group of magnetic type resonant markers 112 are substantially similar such that they are operable to resonate when exposed to the same selected frequency or frequency range of emitted electromagnetic energy 116, thereby, for example identifying a resonant marker as belonging to a particular denomination or other subset. Variations may further uniquely identify the resonant marker within a denomination or subset or across an entire valid set of gaming chips 104.

Embodiments of the gaming chip identification system 102 recognize the occurrence of these variations between substantially similar magnetic type resonant markers 112. Accordingly, these slightly different magnetic type resonant markers 112, even though they may be substantially similar so as to form a group, will generate discernibly different electromagnetic signatures 124 when exposed to the same preselected frequency or frequency range of emitted electromagnetic energy 116. During testing, described in greater detail herein below, the respective electromagnetic signature 124 for each magnetic type resonant marker 112 is identified and stored in the electromagnetic signature database 130. Therefore, the discernibly different electromagnetic signatures 124 can be used to later identify any particular magnetic type resonant marker 112. Since various embodiments of the gaming chips 104 may have at least one magnetic type resonant marker 112, the gaming chip 104 is identifiable by detecting the discernibly different electromagnetic signatures 124 from their respective magnetic type resonant marker 112.

RLC Resonant Markers

The second exemplary type of resonant marker 112 used by embodiments of the gaming chip identification system 102 employs one or more RLC circuits 200. A portion of the emitted electromagnetic energy 116 is absorbed by the RLC type resonant marker 112. The absorbed electromagnetic energy causes a detectable modulation in the returned electromagnetic energy 120 which is detected by the receiver 108.

Figure 2:
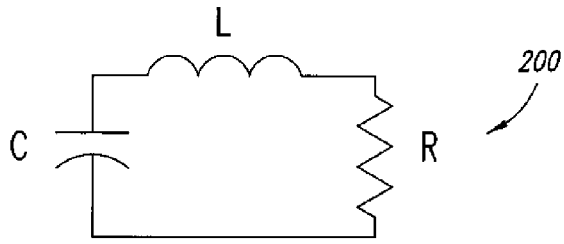
FIG. 2 is an electrical schematic diagram showing an equivalent resistor, inductor, capacitor (RLC) circuit which characterizes the electrical properties of an RLC type resonant marker according to one illustrated embodiment.

FIG. 2 illustrates an equivalent RLC circuit 200 which characterizes the electrical properties of an RLC type resonant marker 112. The equivalent RLC circuit 200 of the RLC type resonant marker 112 may be further characterized by its admittance that exhibits a relatively high admittance Q at the resonant frequencies of the equivalent RLC circuit 200.

The RLC type resonant marker 112 may be comprised of any suitable element and/or one or more components, which may be characterized by the equivalent RLC circuit 200. When exposed to the incident electromagnetic energy 116 emitted by transmitter 106, the RLC type resonant marker 112 will electrically resonate. The characteristics of the resonation, and the impact of the resonation on the returned electromagnetic energy 120, may be determinable by the characteristics of the equivalent RLC circuit 200.

Accordingly, the emitted electromagnetic energy 116 is selected to have at least a frequency component or frequency range which corresponds to the resonant frequency of the equivalent RLC circuit 200. When resonating in response to absorbing electromagnetic energy at or near the resonant frequency, the equivalent RLC circuit 200 may be alternatively referred to as "ringing" or as having a "sustained electrical oscillation."

When resonating, the resistive component of the equivalent RLC circuit absorbs energy (real power). The inductive and capacitive components of the equivalent RLC circuit absorb reactive energy to establish magnetic and/or electric fields. This energy absorption causes a discernable modulation in the returned electromagnetic energy 120 detectable by selected embodiments of the receiver 108. That is, the emitted electromagnetic energy 116 is discernibly different from the returned electromagnetic energy 120. Some embodiments of the gaming chip identification system 102 are operable to compare the emitted electromagnetic energy 116 and the returned electromagnetic energy 120 to determine the respective electromagnetic signature(s) 124 of the RLC type resonant marker 112.

When the emitted electromagnetic energy 116 is removed, such as when the transmitter 106 ceases transmission, the equivalent RLC circuit of the RLC type resonant marker 112 continues to resonate. The resonance decays at an exponential rate determinable from the equivalent RLC circuit 200. The decaying resonance of the RLC type resonant marker 112 releases electromagnetic energy. This returned electromagnetic energy 120 from the RLC type resonant marker 112 is detectable by selected embodiments of the receiver 108. Accordingly, some embodiments of the gaming chip identification system 102 are operable to determine the respective electromagnetic signature(s) 124 from the returned electromagnetic energy 120 (after the transmitter 106 ceases transmission).

U.S. Pat. No. 3,766,452 to Burpee et al. describes a gaming chip with a detectable RLC type marker. However, Burpee et al. is limited to detecting only the presence of RLC type markers when the markers are exposed to emitted electromagnetic energy of a preselected frequency or frequency range. Burpee et al. does not disclose identifying individual gaming chips 104 by the unique electromagnetic signature 124 generated by the magnetic type resonant marker 112 residing therein when the group of individual gaming chips 104 are exposed to the same selected frequency or frequency range of emitted electromagnetic energy. Nor does Burpee et al. disclose identifying a denomination of individual gaming chips 104 by an electromagnetic signature 124 that is unique to the denomination generated by the magnetic type resonant marker 112 residing therein when the group of individual gaming chips 104 are exposed to the same selected frequency or frequency range of emitted electromagnetic energy.

During the manufacturing process, some variation between individual RLC type resonant markers 112 in a group of substantially similar RLC type resonant markers 112 will inevitably occur. For example, manufacturing tolerances may be set so as to ensure that individual RLC type resonant markers 112 of the denomination, subset or set, have substantially similar dimensions of their components. However, such manufacturing tolerances inherently allow slightly different physical dimensions between the components of the RLC type resonant markers 112 as they are manufactured. As another example, the material composition of the components of individual RLC type resonant markers 112 of the group may vary slightly from marker to marker due to inherent material composition tolerances. If the components of the RLC type resonant markers 112 are shaped in a particular manner during the manufacturing process, slight variations in shape will occur from marker to marker due to inherent variations outside of control based on the particular fabrication tolerances. It is appreciated that in any manufacturing process, such variations in dimensions, material compositions, and/or shape will likely occur. So long as such variations are within design tolerances, a group of RLC type resonant markers 112 are substantially similar such that they are operable to resonate when exposed to the same selected frequency or frequency range of emitted electromagnetic energy 116.

Embodiments of the gaming chip identification system 102 recognize the occurrence of these variations between substantially similar RLC type resonant markers 112. Accordingly, these slightly different RLC type resonant markers 112, even though they may be substantially similar so as to form a group (e.g., denomination, subset or set), will generate discernibly different electromagnetic signatures 124 when exposed to the same selected frequency or frequency range of emitted electromagnetic energy 116. During testing, described in greater detail herein below, the respective electromagnetic signature 124 for each RLC type resonant marker 112 is identified and stored in the electromagnetic signature database 130. Therefore, the discernibly different electromagnetic signatures 124 can be used to later identify any particular RLC type resonant marker 112. Since various embodiments of gaming chips 104 may have at least one RLC type resonant marker 112, the denomination is identifiable and/or the individual gaming chip 104 is uniquely identifiable by detecting the discernibly different electromagnetic signatures 124 from their respective RLC type resonant marker 112.

In one embodiment, the RLC type resonant marker 112 comprises one or more shaped metallic wires. The wire may be shaped such that an inductance and/or capacitance is formed. As a result of the wire shape, the RLC type resonant marker 112 is generally responsive to the selected resonant frequency. Thus, an equivalent RLC circuit 200 may be formed by the shaped metallic wire. Wires may be randomly shaped, or wires may be shaped to a desired form.

If portions of the wire are parallel, the capacitive component of the RLC type resonant marker 112 is determinable, measurable, or otherwise known. In other embodiments, two separated metallic surfaces or plates may be used to form a capacitive element. Separation distance and surface size may be controlled such that the capacitance of the element is determinable, measurable, or otherwise known.

One or more wire coils or loops may be used to form the inductive element of the equivalent RLC circuit 200. Coil or loop dimensions may be defined such that the inductance of the element is determinable, measurable, or otherwise known.

The wire is resistive. Thus, the resistive component of the RLC type resonant marker 112 is determinable, measurable, or otherwise known. Multiple elements may be physically and electrically coupled using the above-described metallic wire.

Different metal types have different electrical properties. Thus, selection of the metal used to form the wire will influence the characteristics of the RLC type resonant marker 112. For example, iron and copper have different resistive characteristics, which will influence the resistive component of the equivalent RLC circuit 200.

The above-described components of the RLC type resonant markers 112 may be encapsulated or affixed to a gaming chip 104 in a specified manner such that the components are encapsulated or affixed in a consistent manner among a group of gaming chips 104. In other embodiments, the above-described components of the RLC type resonant markers 112 may be encapsulated or affixed to a gaming chip 104 in a random manner to further vary the electromagnetic signature 124 between gaming chips 104.

Cavity Resonant Markers

The third exemplary type of resonant marker 112 used by embodiments of the gaming chip identification system 102 employs one or more cavities in the gaming chip 104. A portion of the emitted electromagnetic energy 116 is absorbed by the cavity type resonant marker 112. The absorbed electromagnetic energy causes a detectable modulation in the returned electromagnetic energy 120, which is detected by the receiver 108.

The cavity type resonator maker 112 has interior surfaces that reflect electromagnetic waves. When a resonant frequency electromagnetic wave enters the cavity type resonator maker 112, the electromagnetic wave is reflected from the interior surfaces of the cavity type resonator maker 112 with low or no loss. Non-resonant frequency electromagnetic waves are reflected from the interior surfaces of the cavity type resonator maker 112 with higher loss and die out. The resonant frequency electromagnetic waves are standing waves in the cavity type resonator maker 112. The standing wave of the resonant frequency electromagnetic wave is reinforced by transmitting additional resonant frequency electromagnetic wave into the cavity type resonator maker 112, thereby increasing the intensity of the standing wave. The resonant frequency of the cavity type resonator maker 112 is determined by the shape of the cavity and the mode, or allowable field distribution, of the electromagnetic energy that the cavity contains. Microwave transmission devices use such cavities.

Accordingly, the emitted electromagnetic energy 116 is selected to have at least a frequency component or frequency range which corresponds to the resonant frequency of the cavity type resonator maker 112. When resonating in response to absorbing electromagnetic energy at or near the resonant frequency, the cavity type resonator maker 112 may be alternatively referred to as "ringing" or as having a "sustained electrical oscillation."

When the emitted electromagnetic energy 116 is removed, such as when the transmitter 106 ceases transmission, the cavity type resonant marker 112 continues to resonate. The resonance decays at an exponential rate and releases electromagnetic energy. This returned electromagnetic energy 120 from the cavity type resonant marker 112 is detectable by selected embodiments of the receiver 108. Accordingly, some embodiments of the gaming chip identification system 102 are operable to determine the respective electromagnetic signature(s) 124 from the returned electromagnetic energy 120 (after the transmitter 106 ceases transmission). Among other things, the electromagnetic signature for the cavity type resonator marker 112 is a function of the shape and size of the cavity, the number openings to the cavity, the shape of the opening(s) to the cavity, the size of the opening(s) to the cavity, and the location of the opening(s).

During the manufacturing process, some variation between individual cavity type resonant markers 112 in a group of substantially similar cavity type resonant markers 112 will inevitably occur. For example, manufacturing tolerances may be set so as to ensure that individual cavity type resonant markers 112 of the group have substantially similar dimensions. However, such manufacturing tolerances inherently allow slightly different physical dimensions between cavity type resonant markers 112 as they are manufactured. For example, physical dimensions may vary outside the ability to control such based on the particular manufacturing tolerances (e.g., below $1/100^{th}$ of an inch), providing for a unique characteristic in the respective electromagnetic signatures. As another example, the cavity type resonant markers 112 of the group may vary slightly from marker to marker due to accidental impurities, e.g., unintentionally, material is left in the cavity. As another example, the cavity type resonant markers 112 of the group may vary slightly from marker to marker due to deliberate impurities, e.g., material is intentionally left in the cavity. If the cavity type resonant markers 112 are shaped in a particular manner during the manufacturing process, slight variations in shape will occur from marker to marker due to inherent fabrication tolerances. For example, a geometric shape may vary outside the ability to control such based on the particular manufacturing tolerances (e.g., disk slightly out of round), providing for a unique characteristic in the respective electromagnetic signatures. Similarly, if the cavity type resonant maker has an opening or openings, the size and/or shape and/or location of the opening or openings may vary outside the ability to control such based on the particular manufacturing tolerances, providing for a unique characteristic in the respective electromagnetic signatures. It is appreciated that in any manufacturing process, such variations in dimensions, material compositions, and/or shape will likely occur. So long as such variations are within design tolerances, a group of cavity type resonant markers 112 are substantially similar such that they are operable to resonate when exposed to the same selected frequency or frequency range of emitted electromagnetic energy 116, thereby, for example identifying a resonant marker as belonging to a particular denomination or other subset. Variations may further uniquely identify the resonant marker within a denomination or subset or across an entire valid set of gaming chips 104.

Embodiments of the gaming chip identification system 102 recognize the occurrence of these variations between substantially similar cavity type resonant markers 112. Accordingly, these slightly different cavity type resonant markers 112, even though they may be substantially similar so as to form a group, will generate discernibly different electromagnetic signatures 124 when exposed to the same preselected frequency or frequency range of emitted electromagnetic energy 116. During testing, described in greater detail herein below, the respective electromagnetic signature 124 for each cavity type resonant marker 112 is identified and stored in the electromagnetic signature database 130. Therefore, the discernibly different electromagnetic signatures 124 can be used to later identify any particular cavity type resonant marker 112. Since various embodiments of the gaming chips 104 may have at least one cavity type resonant marker 112, the gaming chip 104 is identifiable by detecting the discernibly different electromagnetic signatures 124 from their respective cavity type resonant marker 112.

Electromagnetic Signatures

Figure 3A:
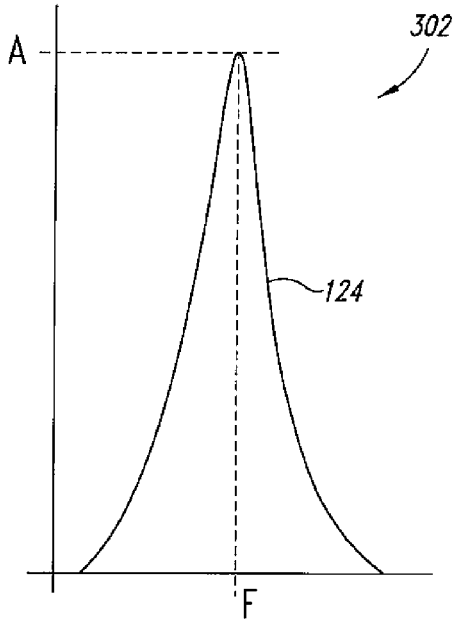
FIG. 3A is a graph showing characteristics of a simplified, illustrative electromagnetic signature from a resonant marker exposed to incident non-optical electromagnetic radiation according to one illustrated embodiment.
Figure 3B:
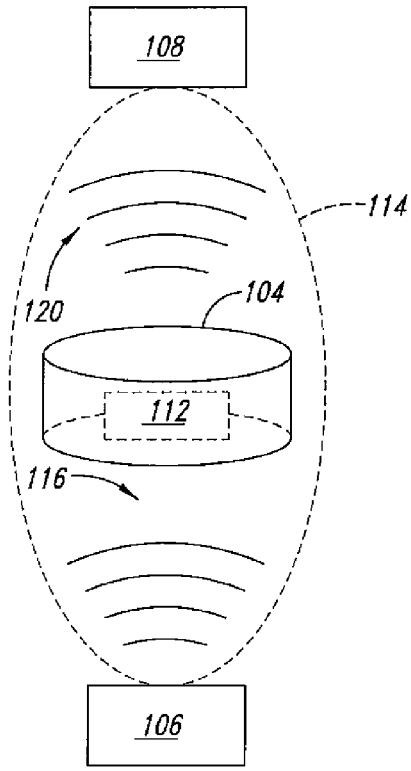
FIG. 3B is a schematic diagram illustrating the transmitter, the receiver 106, and the gaming chip having a resonant marker which generated the electromagnetic signature of FIG. 3A.

FIG. 3A is a graph 302 showing characteristics of a simplified, illustrative electromagnetic signature 124 from a resonant marker 112 exposed to incident non-optical electromagnetic energy according to one illustrated embodiment. FIG. 3B is a schematic diagram illustrating transmitter 106, the receiver 108, and the gaming chip 104 having a resonant marker 112 which generated the electromagnetic signature 302 of FIG. 3A.

The electromagnetic signature 124 illustrates a frequency envelope 302 corresponding to a curve of frequency amplitudes over a frequency range centered about the fundamental frequency F. Thus, the electromagnetic signature 124 may be characterized by an amplitude A at its fundamental frequency F. The frequency F may be the same or substantially the same as the frequency of the emitted electromagnetic energy 116 or the frequency F may be different from the frequency of the emitted electromagnetic energy 116, depending upon the nature of the resonant marker 112.

As generally described herein, the electromagnetic signature 124 is determined by processing system 110 (FIG. 1) based upon analysis of the returned electromagnetic energy 120 detected by receiver 108. For convenience, the electromagnetic signature 124 is illustrated only in a general manner (smooth curve) to illustrate the operational principles employed by embodiments of the gaming chip identification system 102. It is appreciated that an actual electromagnetic signature will exhibit irregularities and/or discontinuities in its frequency response envelope 302. In practice, it is these irregularities and/or discontinuities may allow unique identification of individual electromagnetic signatures 124.

Frequency response of the resonant marker 112 may be analyzed in a variety of other manners. For example, a frequency versus admittance envelope may be determined from the returned electromagnetic energy 120 to define a unique electromagnetic signature 124 of a resonant marker 112. As another example, frequency harmonics of returned electromagnetic energy 120 may be analyzed such that embodiments of the gaming chip identification system 102 may determine an electromagnetic signature 124 of a resonant marker 112. Frequency domain and/or time domain criteria may also be used by embodiments of the gaming chip identification system 102 to analyze returned electromagnetic energy 120 to determine electromagnetic signatures 124. All such various methods and systems analyzing characteristics of the returned electromagnetic energy 120 when one or more resonant markers 112 are in the interrogation zone 114 are intended to be included herein. For brevity, such various systems and methods analyzing the frequency characteristics of the returned electromagnetic energy 120 are not described in detail.

Figure 4A:
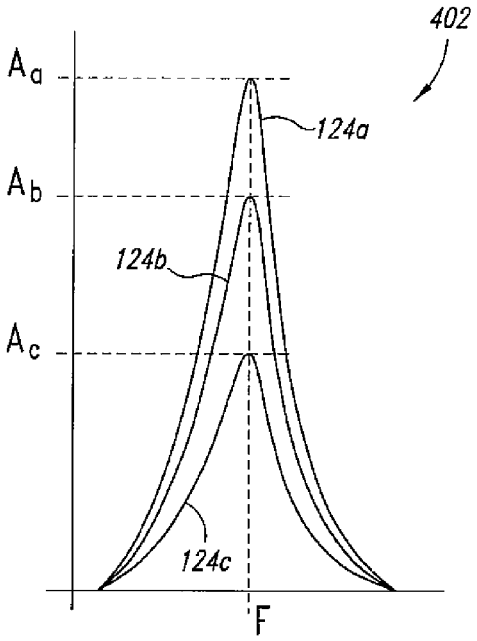
FIG. 4A is a graph showing characteristics of three simplified, illustrative electromagnetic signatures from three resonant markers according to one illustrated embodiment.
Figure 4B:
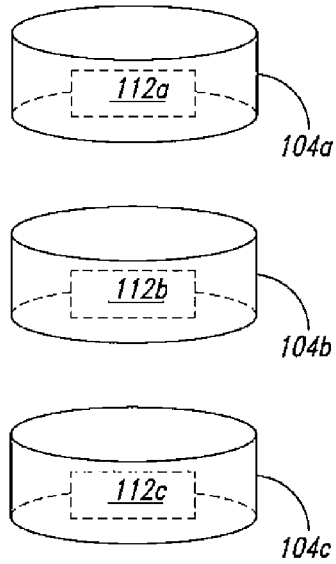
FIG. 4B is a schematic diagram illustrating the three gaming chips with resonant markers which generated the three electromagnetic signatures of FIG. 4A.

FIG. 4A is a graph 402 showing characteristics of three simplified, illustrative electromagnetic signatures 124*a*-124*c* from three resonant markers 112*a*-112*c* (FIG. 4B) according to one illustrated embodiment. FIG. 4B is a schematic diagram illustrating three gaming chips 102*a*-102*c* with resonant markers 112*a*-112*c* which generated the three electromagnetic signatures 124*a*-124*c* of FIG. 4A. Characteristics of the incident electromagnetic energy 116, such as amplitude and/or frequency, are the same or substantially the same for each of the exposed resonant markers 112*a*-112*c*.

The resonant markers 112*a*-112*c* may be sequentially and individually exposed to the incident electromagnetic energy 116 such that three electromagnetic signatures 124*a*-124*c* are separately determined. Or, one or more of the resonant markers 112*a*-112*c* may be concurrently exposed to the incident electromagnetic energy 116 so that their respective electromagnetic signatures 124*a*-124*c* are concurrently determined.

In this simplified illustrative example, the three resonant markers 112*a*-112*c* modulate the returned electromagnetic energy 120 such that their respective electromagnetic signatures 124*a*-124*c* are centered about the above-described fundamental frequency F. However, in this simplified illustrative example, the amplitude of the frequency response for each of the resonant markers 112*a*-112*c* is different (electromagnetic signature 124*a* corresponds to resonant marker 112*a*; electromagnetic signature 124*b* corresponds to resonant marker 112*b*; electromagnetic signature 124*c* corresponds to resonant marker 112*c*). Accordingly, the presence of electromagnetic signature 124*a*, identifiable by its amplitude Aa, indicates that the resonant marker 112*a* is within the interrogation zone 114 (FIG. 1). Similarly, the presence of electromagnetic signature 124*b*, identifiable by its amplitude Ab, and the presence of electromagnetic signature 124*c*, identifiable by its amplitude Ac, indicates that the resonant markers 112*b* and 112*c*, respectively, are within the interrogation zone 114.

Figure 5A:
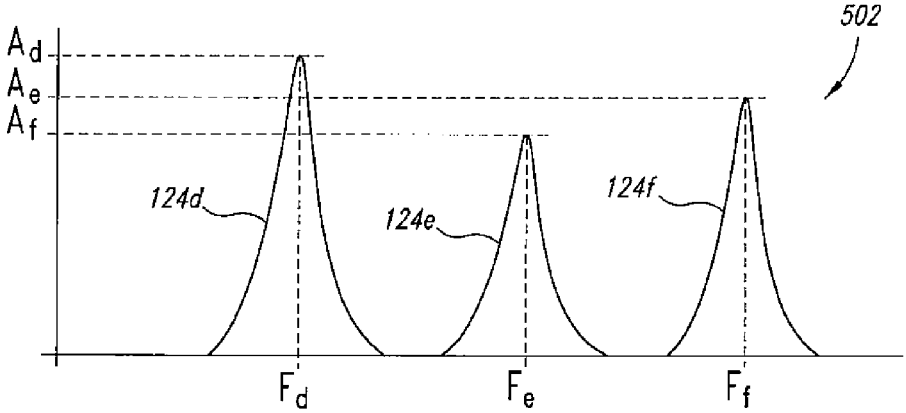
FIG. 5A is a graph illustrating characteristics of three simplified, illustrative electromagnetic signatures from three resonant markers according to one illustrated embodiment.
Figure 5B:
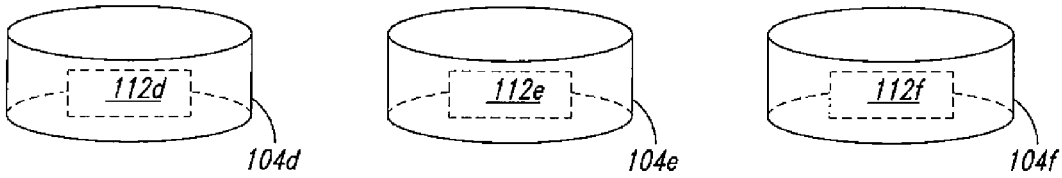
FIG. 5B is a schematic diagram illustrating the three gaming chips with resonant markers which generated the three electromagnetic signatures of FIG. 5A.

FIG. 5A is a graph 502 illustrating characteristics of three simplified, illustrative electromagnetic signatures 124*d*-124*f* from three resonant markers 112*d*-112*f* illustrated in FIG. 5B according to one illustrated embodiment. FIG. 5B is a schematic diagram illustrating the three gaming chips 104*d*-104*f* with resonant markers 112*d*-112*f* which generated the three electromagnetic signatures 124*d*-124*f* of FIG. 5A. Characteristics of the incident electromagnetic energy 116, such as amplitude and/or frequency, are the same or substantially the same for each of the exposed three resonant markers 112*d*-112*f*.

The resonant markers 112*d*-112*f* may be sequentially and individually exposed to the incident electromagnetic energy 116 such that electromagnetic signatures 124*d*-124*f* are separately determined. Or, one or more of the three resonant markers 112*d*-112*f* may be concurrently exposed to the incident electromagnetic energy 116 so that their respective electromagnetic signatures 124*d*-124*f* are concurrently determined.

In this simplified illustrative example, the three resonant markers 112*d*-112*f* modulate the returned electromagnetic energy 120 such that their respective electromagnetic signatures 124*d*-124*f* are centered about different fundamental frequencies Fd-f. (Electromagnetic signature 124*d* corresponds to resonant marker 112*d*; electromagnetic signature 124*e* corresponds to resonant marker 112*e*; electromagnetic signature 124*f* corresponds to resonant marker 112*f*.) Thus, the presence of electromagnetic signature 124*d*, identifiable by its resonant frequency Fd, indicates that the resonant marker 112*d* is within the interrogation zone 114 (FIG. 1). Similarly, the presence of electromagnetic signature 124*e*, identifiable by its resonant frequency Fe, and the presence of electromagnetic signature 124*f*, identifiable by its resonant frequency Ff, indicates that the resonant markers 112*e* and 112*f*, respectively, are within the interrogation zone 114.

To further illustrate possible operational principles, the amplitude of the electromagnetic signatures 124*d*-124*f* for each of the resonant markers 112*d*-112*f* is different. Accordingly, the amplitudes Ad-f may be used to further differentiate and identify electromagnetic signatures 124*d*-124*f* of the resonant markers 112*d*-112*f*, respectively.

As noted above, the characteristics of the emitted electromagnetic energy 116 should be substantially the same when emitted towards a resonant marker 112. The emitted electromagnetic energy 116 may have frequency characteristics spread over a sufficiently broad frequency range so as to ensure that the resonant markers 112 absorb a portion of the emitted energy at their resonant frequencies such that they emit at least a portion of the returned electromagnetic energy 120 which may be detected by the receiver 108.

Figure 6:
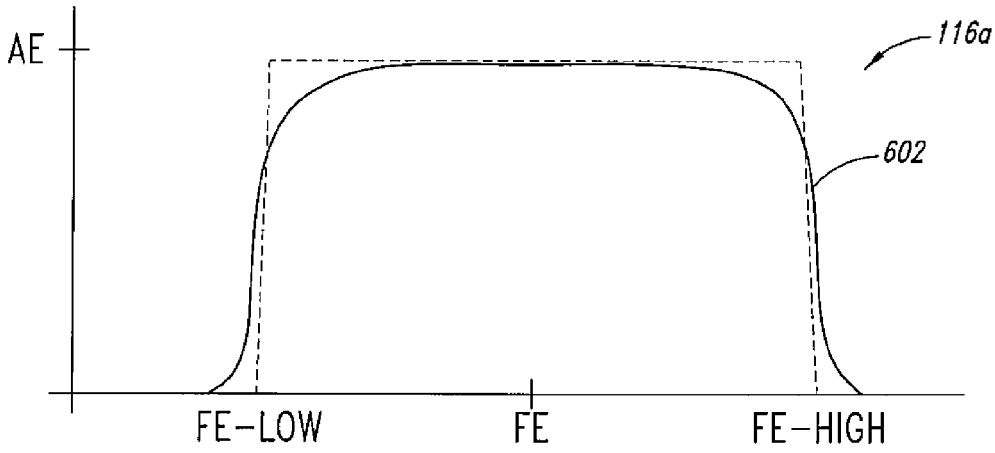
FIG. 6 is a graph showing one form of the emitted electromagnetic energy in alternative illustrated embodiments of the gaming chip identification system.
Figure 7:
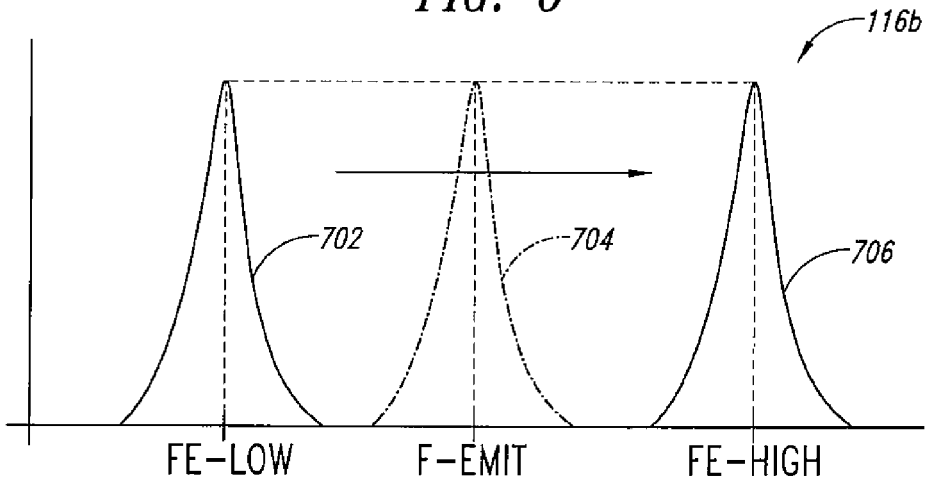
FIG. 7 is a graph illustrating a second form of the emitted electromagnetic energy in alternative illustrated embodiments of the gaming chip identification system.
Figure 8:
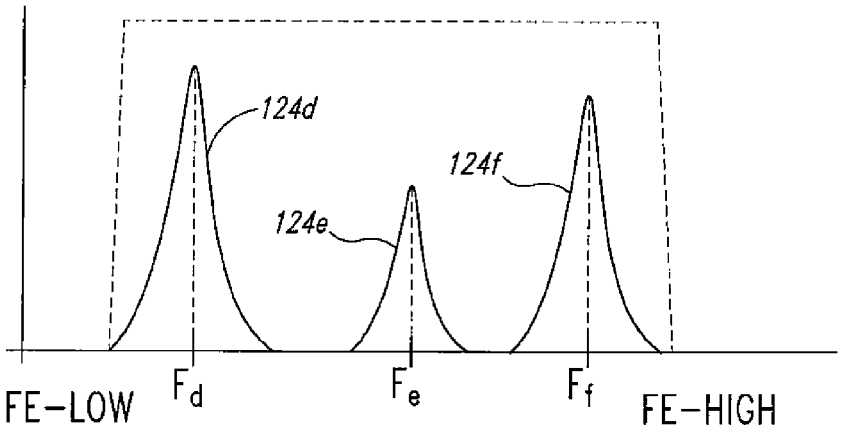
FIG. 8 is a graph showing the above-described electromagnetic signatures of FIG. 5 in context with the emitted electromagnetic energy of FIGS. 6 and 7.

FIGS. 6 and 7 illustrate two exemplary forms of emitted electromagnetic energy 116*a* and 116*b*, respectively, that may be transmitted by transmitter 106 (FIG. 1) in alternative embodiments of the gaming chip identification system 102. FIG. 8 illustrates the above-described electromagnetic signatures 124*d*-124*f* (FIG. 5) in context with the emitted electromagnetic energy 116*a* and 116*b*.

The emitted electromagnetic energy 116*a* illustrated in FIG. 6 may be characterized by a frequency envelope 602. Frequency envelope 602 corresponds to a frequency curve having non-zero amplitudes at least between a low frequency (FE-LOW) and a high frequency (FE-HIGH). Alternatively, the characteristics of the frequency envelope 602 may be described as being within a frequency range centered about a fundamental frequency (FE).

For convenience, the amplitude of the emitted electromagnetic energy 116*a* is illustrated as AE, which is relatively constant across the illustrated low frequency and high frequency. However, the amplitude of the various portions of the frequency envelope 602 need not be equal as illustrated.

As noted above, the emitted electromagnetic energy 116*a* will have frequency characteristics spread over a sufficiently broad frequency range (FE-LOW to FE-HIGH) so as to ensure that the resonant markers 112 of a group absorb a portion of the emitted electromagnetic energy 116 at their resonant frequencies such that they emit at least a portion of the returned electromagnetic energy 120 which may be detected by the receiver 108. FIG. 8 illustrates the electromagnetic signatures 124*d*-124*f* of the above-described resonant markers 112*d*-112*f* (FIG. 5). The resonant frequencies Fd-f are within the frequency range (FE-LOW to FE-HIGH) of the emitted electromagnetic energy 116*a*.

Transmitters 106 are operable to emit electromagnetic energy that may be characterized by the frequency envelope 602 having the frequency range (FE-LOW to FE-HIGH). However, in some embodiments of the gaming chip identification system 102, such transmitters 106 may not be available or practical if the frequency range (FE-LOW to FE-HIGH) is relatively large. In such embodiments, the transmitter 106 may be operable to emit electromagnetic energy 116 having a relatively smaller frequency range centered about a controllable frequency (F-EMIT). In alternative embodiments, a plurality of transmitters 106 may be used to transmit portions of the above-described broad frequency range (FE-LOW to FE-HIGH).

FIG. 7 illustrates a transmitter 106 embodiment which is operable to emit electromagnetic energy 116 having a relatively smaller frequency range centered about a controllable frequency (F-EMIT). The transmitter 106 is operated such that, over some period of time, the controllable frequency (F-EMIT) is adjusted across the frequency range defined between the above-described broad frequency range (FE-LOW to FE-HIGH). To illustrate, at the initial time, the transmitter 106 outputs electromagnetic energy 116 at an initial controllable frequency corresponding to the low emitted frequency (FE-LOW), generally illustrated by the frequency envelope 702. Then, transmitter 106 increases the frequency of the emitted controllable frequency (F-EMIT). For example, the controllable frequency (F-EMIT) may be increased to the exemplary frequency envelope 704. At the end of the time period, the transmitter 106 outputs electromagnetic energy 116 at an ending controllable frequency corresponding to the high emitted frequency (FE-HIGH), generally illustrated by the frequency envelope 706.

For convenience, the above-described process of adjusting the controllable frequency over a broad frequency range may be referred to as "sweeping" the emitted frequency over a frequency range or over selected frequencies. Such sweeping of the emitted controllable frequency may be done in a continuous manner or in a step-wise manner. The sweeping may be done in a manner which increases frequency or which decreases frequency. Or, a plurality of transmitters 106 may be used to sweep over smaller portions of the above-described broad frequency range (FE-LOW to FE-HIGH).

Testing a Group of Manufactured Resonant Markers

During the manufacturing process, some variation between individual magnetic type resonant markers 112, RLC type resonant markers 112, and cavity type resonant markers 112 in a group of substantially similar markers 112 will inevitably occur. The variation may be intentionally introduced within control of the manufacturing process based on the particular manufacturing tolerances employed. In other instances, the variation may be unintentionally introduced, outside of control of the manufacturing process based on the particular manufacturing tolerances employed.

Substantially similar resonant markers 112 may be characterized as a plurality of resonant markers 112 having their resonant frequencies within the above-described frequency range (FE-LOW to FE-HIGH) so as to ensure that the resonant markers 112 of the group (e.g., denomination or other subset, or a set) absorb a portion of the emitted electromagnetic energy 116.

For example, individual resonant markers 112 of a denomination or other subset may have similar general physical dimensions, but may also have slightly different detailed physical dimensions. For instance, the individual resonant markers 112 of the denomination or other subset may identical general physical dimensions within the manufacturing tolerances, but may also have discernibly different detailed physical dimensions beyond the manufacturing tolerances. As another example, individual resonant markers 112 of a denomination or other subset may have similar general material composition, but may also have slightly different detailed material composition. For instance, individual resonant markers 112 of the denomination or other subset may have similar general material composition within the manufacturing tolerances, but may also have slightly different material composition from marker to marker beyond the manufacturing tolerances. As a further example, individual resonant markers 112 of a denomination or other subset may have similar general shape, but may also have slight differences in the details of the shapes. For instance, the resonant markers 112 of the denomination or other subset may have similar general shape (e.g., round, rectangular, square, triangular, pentagon) within the manufacturing tolerances, but may differ in detail (e.g., not precisely parallel sides, slightly out of round) beyond control of the particular manufacturing tolerances. It is appreciated that in any manufacturing process, such variations in dimensions, material compositions, and/or shape will occur. In fact, the manufacturing tolerances may be selected to introduce or enhance these differences, based in part on the ability to produce discernable resonant responses. So long as such variations are within design tolerances, the manufactured individual resonant markers 112 are deemed to be substantially similar and operable to resonate when exposed to the same preselected frequency or frequency range of emitted electromagnetic energy 116.

As noted above, embodiments of the gaming chip identification system 102 recognize the existence of these variations between substantially similar resonant markers 112 and that such resonant markers 112 will generate discernibly different electromagnetic signatures 124 when exposed to the same selected frequency or frequency range of emitted electromagnetic energy 116. The discernibly different electromagnetic signatures 124 may be advantageously used to uniquely identify any particular resonant marker 112. Once the respective electromagnetic signature 124 is identified and stored in the electromagnetic signature database 130, the gaming chip 104 may be associated with the resonant marker 112. The resulting gaming chips 104 may form a valid set of gaming chips 104, where each gaming chip has a resonant marker that produces a resonant response indicative of denomination and/or indicative of a unique identity.

Figure 9:
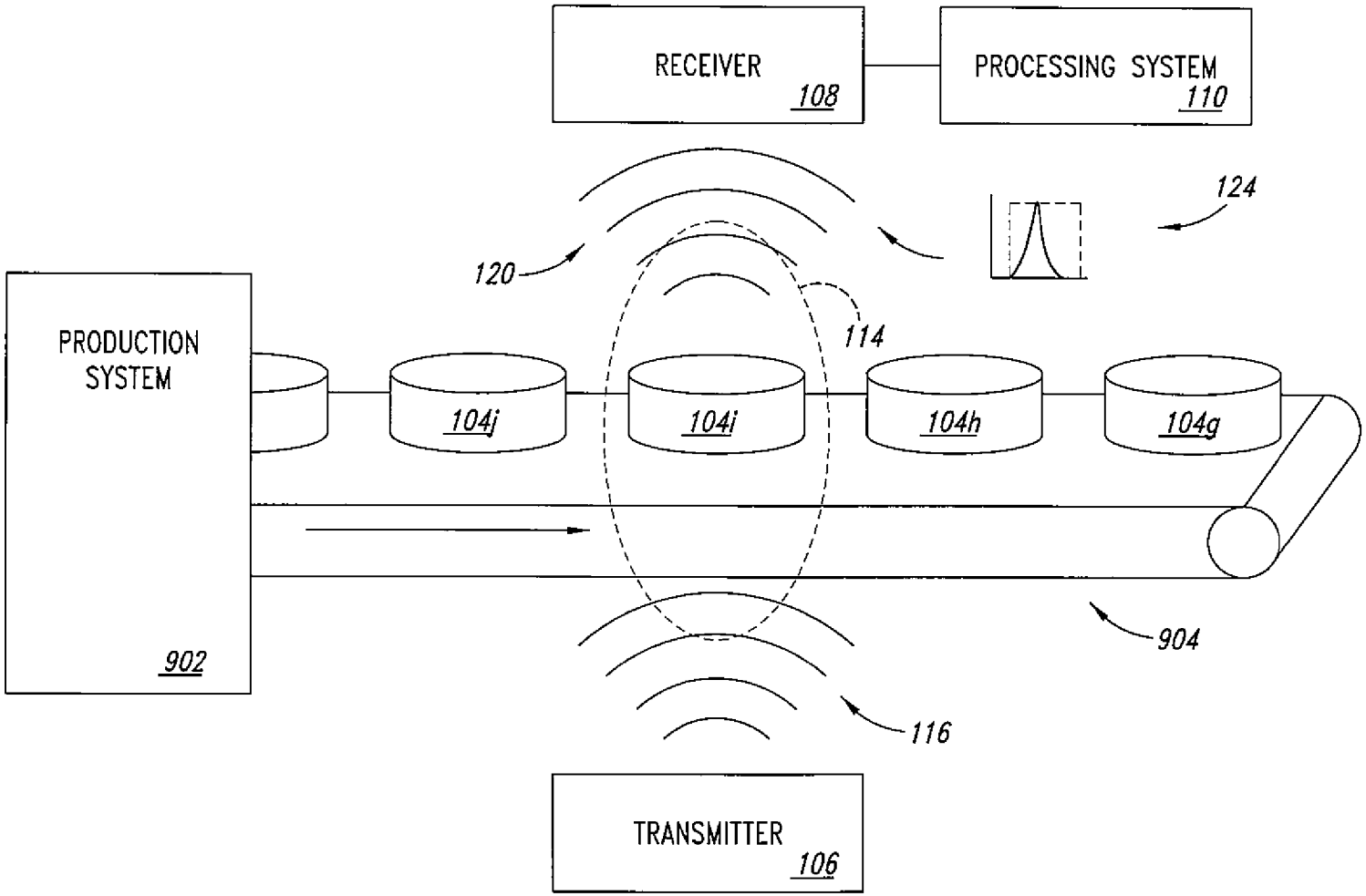
FIG. 9 is a schematic diagram illustrating a production system producing a plurality of gaming chips having magnetic type resonant markers and/or RLC type resonant markers according to one illustrated embodiment.

FIG. 9 illustrates a production system 902 producing a plurality of gaming chips **104*j*-104*l* having magnetic type resonant markers 112 and/or RLC type resonant markers 112 and/or cavity type resonant makers 112. The gaming chips 104*j*-104*l* are being transported along a conveyor system 904. At any given time during the production process, only one of the gaming chips 104*j*-104*l* is within the interrogation zone 114. For convenience, the gaming chip 104*l* is illustrated in the interrogation zone 114**.

As one of the gaming chips **104*j*-*l* passes into the interrogation zone 114, transmitter 106 emits electromagnetic energy 116. In response to the incident electromagnetic energy 116, the resonant marker 112 in the gaming chip 104 modulates and returns electromagnetic energy 120. Receiver 108 detects the returned electromagnetic energy 120 and communicates the information to processing system 110 such that the electromagnetic signature 124 for the gaming chip in the interrogation zone 114** is determined. For convenience, this process of exposing a gaming chip to electromagnetic energy and determining the electromagnetic signature is referred to as testing. The gaming chip in the interrogation zone is referred to as the tested gaming chip.

As the next gaming chip is transported into the interrogation zone 114, that gaming chip is tested to determine its respective electromagnetic signature 124. Information corresponding to the determined electromagnetic signature 124 is stored in the electromagnetic signature database 130 (FIG. 1).

It is appreciated that in other embodiments of the gaming chip identification system 102, resonant markers 112 may be individually tested to determine their respective electromagnetic signatures. Then, the tested resonant markers 112 may be inserted into or otherwise attached to a gaming chip 104.

During the testing of a group of substantially similar magnetic type resonant markers 112 (or their gaming chips 104), if two electromagnetic signatures 124 are determined that are not discernible or differentiable from each other, then one of the resonant markers 112 (or its respective gaming chip 104) is identified as a duplicate. The duplicate resonant marker 112 (or duplicate gaming chip 104) may be identified and discarded or otherwise removed from its respective group. That is, if two magnetic type resonant markers 112 have identical or substantially matching electromagnetic signatures 124, one of the two markers 112 (or gaming chips 104) is removed from the group. It is appreciated that the above-described variances in dimensions, material compositions, and/or shape will allow a sufficient population of uniquely identifiable markers 112 to be uniquely identified. Identification may include writing or otherwise inscribing suitable indicia on the resonant marker 112 or associated gaming chip 104. The resonant markers 112 or associated gaming chips 104 may form a valid set of resonant markers 112 or associated gaming chips 104 for a casino or other property.

Developing a Database of Electromagnetic Signatures

As a group of resonant markers 112 (or their respective gaming chips 104) are being tested, the electromagnetic signatures 124 are determined by processing system 110. The determination is performed by processor 126, which has retrieved and executed the electromagnetic signature analysis logic 132 (FIG. 1). Memory 128 is any suitable processor-readable memory that stores processor executable instructions residing in logic 132.

Figure 10:
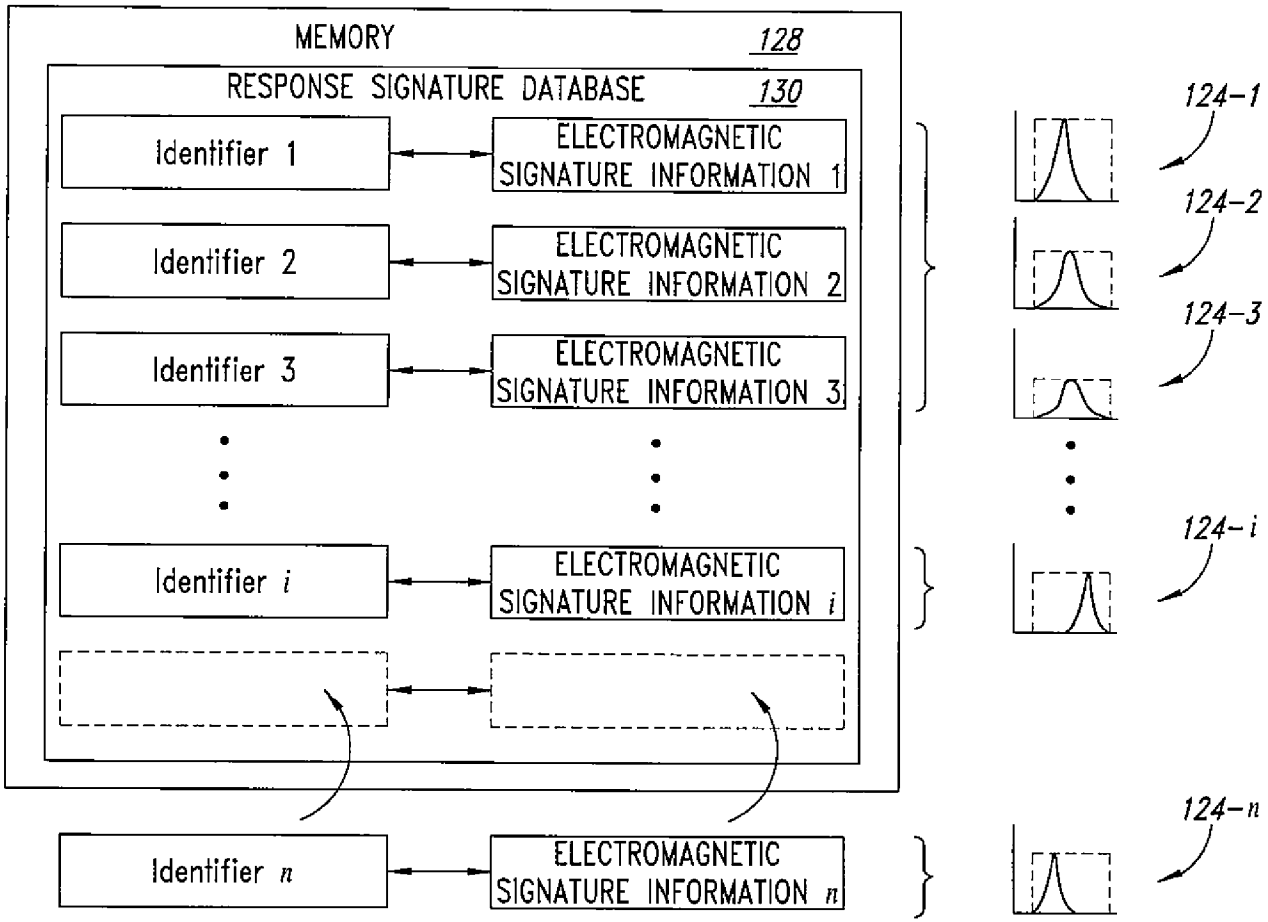
FIG. 10 is a block diagram showing an embodiment of the electromagnetic signature database illustrated in FIG. 1 according to one illustrated embodiment.

FIG. 10 is a block diagram illustrating an embodiment of the electromagnetic signature database 130 (FIG. 1). Each determined respective electromagnetic signature 124 is stored in the electromagnetic signature database 130 with an associated unique identifier. The identifier is further associated with or assigned to the gaming chip 104 having the resonant marker 112 which generated that electromagnetic signature 124. An exemplary identifier is a serial number or the like, although such does not need to be sequential, and may include symbols other than numbers, for example alphabetic characters. The unique identifier may then be used to identify a gaming chip 104 having the resonant marker 112 which generated the unique electromagnetic signature 124.

Other information, such as the value of the gaming chip 104, production information, location information, or the like, may also be associated with the identifier. This other information may be stored in the electromagnetic signature database 130 or in another suitable database.

In the simplified exemplary electromagnetic signature database 130, a plurality of identifiers are associated with the determined electromagnetic signatures 124. For example, identifier 1 is associated with the electromagnetic signature information 1, which corresponds to the electromagnetic signature 124-1.

When a resonant marker 112 (or its respective gaming chip 104) is placed in an interrogation zone 114, returned electromagnetic energy 120 is detected and the electromagnetic signature **124*n* is determined. The determined electromagnetic signature 124*n* is compared with electromagnetic signatures 124-1 through 124-*i* residing in the electromagnetic signature database 130. For example, when the $n^{th}$ electromagnetic signature 124-*n* is determined, the $n^{th}$ electromagnetic signature information is determined and compared with the electromagnetic signature information 1-*i*. If the $n^{th}$ electromagnetic signature information substantially matches or substantially corresponds to one of the stored electromagnetic signature information 1-*i* entries, such that the $n^{th}$ electromagnetic signature information cannot be differentiated from the matched electromagnetic signature information, that $n^{th}$ electromagnetic signature information is not stored in the electromagnetic signature database 130**. Further, no identifier is assigned.

As noted above, if the determined $n^{th}$ electromagnetic signature information cannot be differentiated from the other electromagnetic signature information already stored in the electromagnetic signature database 130, the resonant marker 112 (or the corresponding gaming chip 104) is removed from the group. The removed resonant marker 112 (or the corresponding gaming chip 104) may be used in another group of gaming chips or may be destroyed or discarded.

However, if the information corresponding to the determined electromagnetic signature does not substantially match or substantially correspond with the other previously stored electromagnetic signature information residing in the electromagnetic signature database 130, a unique identifier is assigned to the determined electromagnetic signature information. The electromagnetic signature information and the unique identifier are stored in the electromagnetic signature database 130.

Summarizing, when the $n^{th}$ electromagnetic signature 124-*n* is determined, the corresponding $n^{th}$ electromagnetic signature information is determined and compared with the electromagnetic signature information 1-*i* in the electromagnetic signature database 130. If the $n^{th}$ electromagnetic signature information does not substantially match or substantially correspond to one of the previously-stored electromagnetic signature information 1-*i* entries, that $n^{th}$ electromagnetic signature information is assigned a unique identifier and is stored in the electromagnetic signature database 130 with the corresponding identifier.

Identifying Gaming Chips

Gaming chips 104 are identified in a similar manner as described above for the testing of the gaming chips 104 (or resonant markers 112). The gaming chip 104, when placed in an interrogation zone 114, is exposed to emitted electromagnetic energy 116. The returned electromagnetic energy 120 is analyzed to determine the electromagnetic signature 124. The determined electromagnetic signature 124 is compared with other electromagnetic signatures in the database 130. Upon matching the determined electromagnetic signature 124 with electromagnetic signatures in the database 130, the identity of the gaming chip is determinable by retrieving the corresponding identifier.

Embodiments of the gaming chip identification system 102 may be located where gaming chips 104 having the resonant markers 112 are being used for games or are being processed. For example, embodiments of the gaming chip identification system 102 could be located at a black jack, craps or roulette table. Embodiments of the gaming chip identification system 102 could be located at a cashier cage or in a counting room where the gaming chips 104 are being processed. Embodiments of the gaming chip identification system 102 could even be used in mobile devices, such as portable chip holding trays or carts.

The processing system 110 is operable to provide indications when one or more gaming chips 104, when in the interrogation zone 114, are emitting electronic signatures corresponding to one of the electronic signatures stored in database 130. For example, when a gaming chip 104 emits an electronic signature that corresponds to one of the electronic signatures stored in database 130, the processing system 110 may provide an indication that the tested gaming chip 104 is a member of the group (e.g., set, denomination or other subset). On the other hand, when a gaming chip 104 emits an electronic signature that does not correspond to one of the electronic signatures stored in database 130, processing system 110 may provide an indication that the tested gaming chip 104 is not a member of the group.

PROCESS EMBODIMENTS

FIGS. 11A-14B are flowcharts 1100, 1200, 1300, and 1400, respectively, illustrating various embodiments of a process used by embodiments of the gaming chip identification system 102 (FIG. 1). The flowcharts 1100, 1200, 1300, and 1400 show the architecture, functionality, and operation of a possible implementation of the software for implementing the electromagnetic signature analysis logic 132. In this regard, each block may represent a module, segment, or portion of code which comprises one or more executable instructions for implementing the specified logical function(s). It should be noted that in alternative embodiments, the functions noted in the blocks may occur out of the order noted in FIGS. 11A-14B, or may include additional functions. For example, two blocks shown in succession in FIGS. 11A-14B may in fact be substantially executed concurrently, the blocks may sometimes be executed in the reverse order, or some of the blocks may not be executed in all instances, depending upon the functionality involved, as will be further clarified herein below. All such modifications and variations are intended to be included herein within the scope of this disclosure.

Figure 11A:
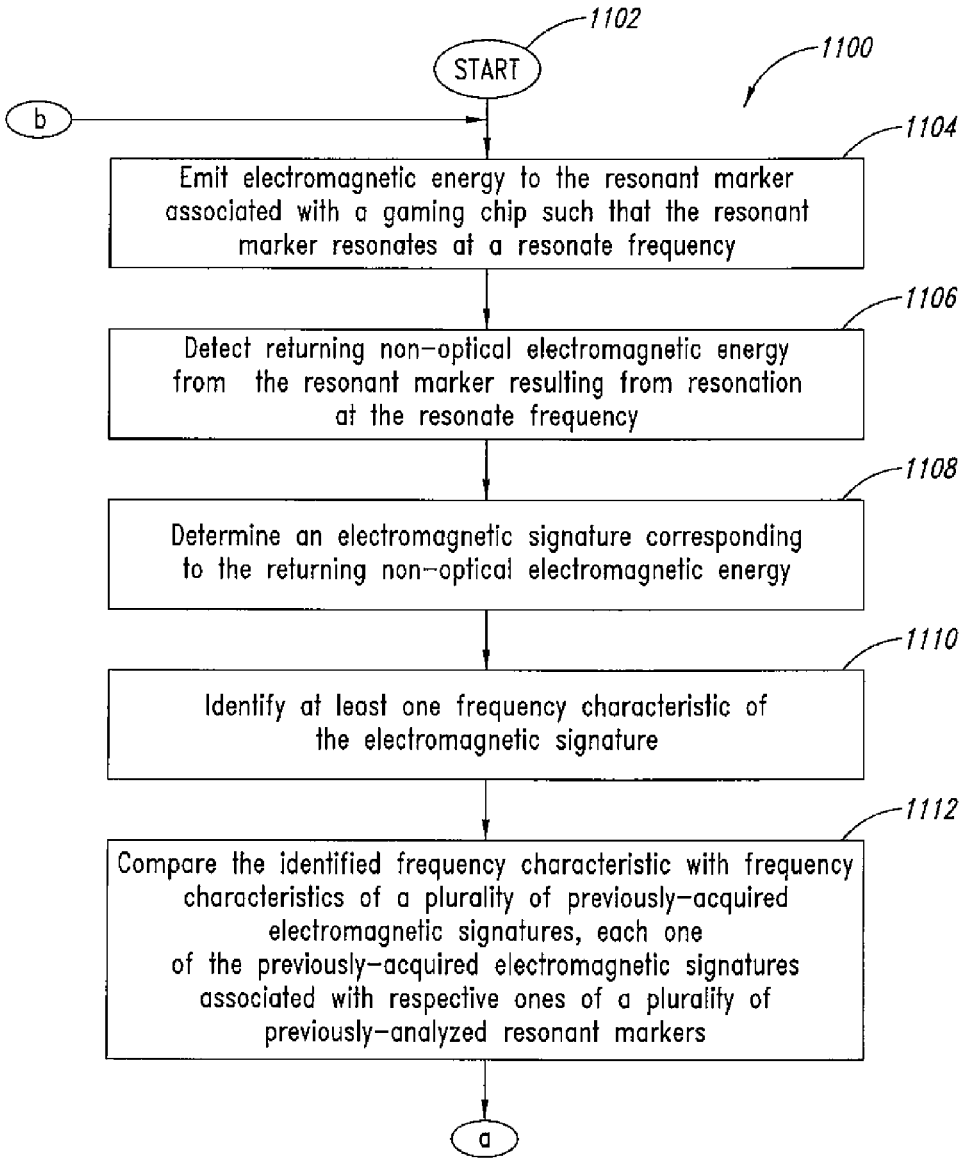
FIGS. 11A and 11B are a flowchart illustrating an embodiment of a process for uniquely identifying a plurality of like gaming chips with resonant markers.
Figure 11B:
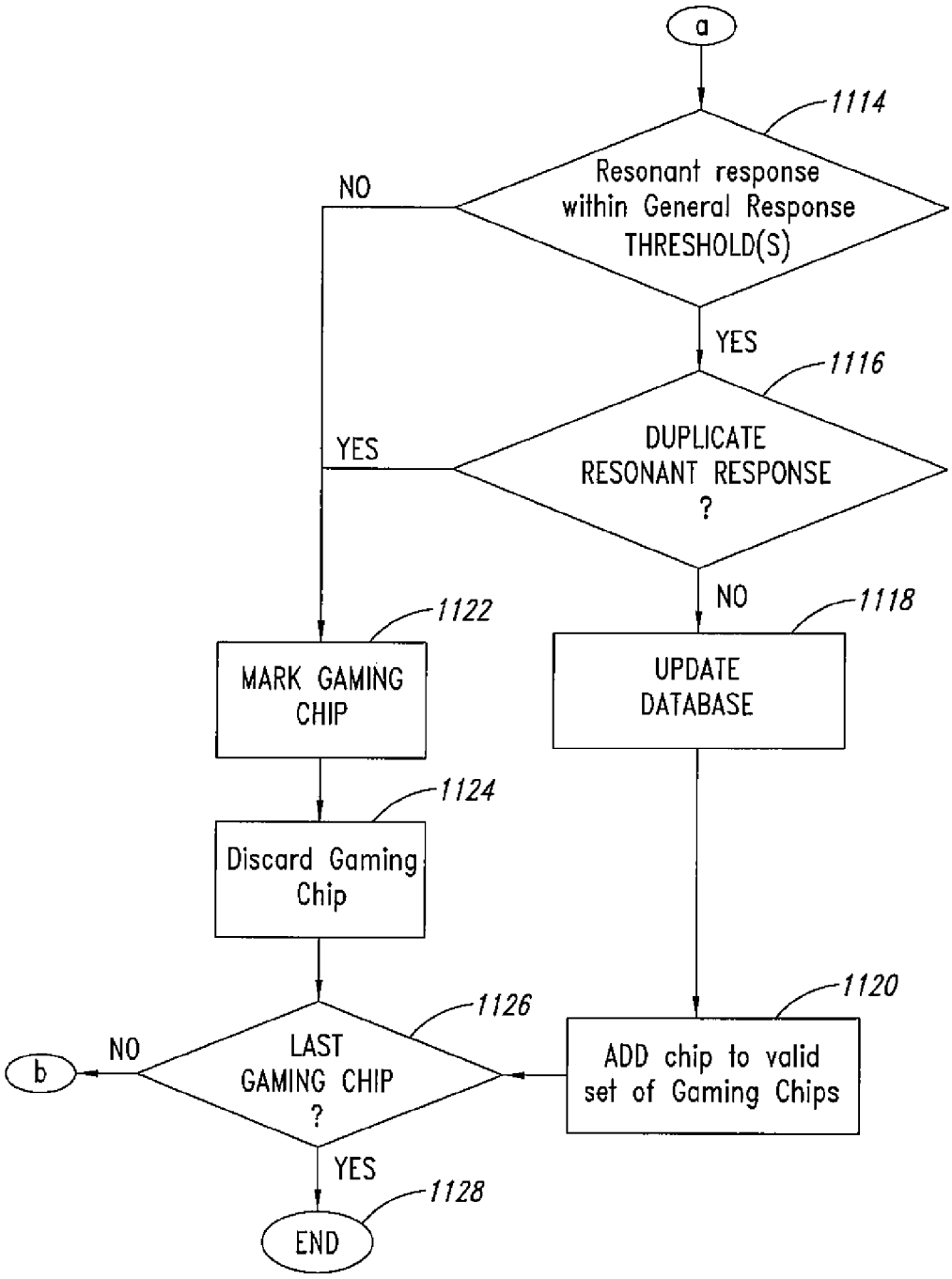

FIGS. 11A and 11B make up a flowchart 1100 illustrating an embodiment of a process for uniquely identifying a plurality of like gaming chips with resonant markers. The process begins at block 1102. At block 1104, electromagnetic energy is emitted to the resonant marker associated with a gaming chip such that the resonant marker resonates at a resonant frequency. At block 1106, returning non-optical electromagnetic energy is received from the resonant marker resulting from resonation at the resonant frequency. At block 1108, an electromagnetic signature is determined corresponding to the returning non-optical electromagnetic energy. At block 1110, at least one frequency characteristic of the electromagnetic signature is identified. At block 1112, the identified frequency characteristic is compared with frequency characteristics of a plurality of previously-acquired electromagnetic signatures, each one of the previously-acquired electromagnetic signatures uniquely associated with one of a plurality of previously-analyzed resonant markers. At block 1114, a determination is made as to whether the resonant response is within a general response threshold or thresholds. If the resonant response is within a general response threshold or thresholds, the process continues at block 1116. Otherwise, the process continues at block 1122. At block 1116, a determination is made as to whether the resonant response is a duplicate resonant response. If the resonant response is not a duplicate resonant response, the process continues at block 1118. Otherwise, the process continues at block 1122. At block 1118, the electromagnetic signature database is updated. At block 1120, the gaming chip is added to the set of valid gaming chips. At block 1122, the gaming chip is marked, and at block 1124, the gaming chip is discarded. At 1126, a determination is made as to whether the gaming chip was the last gaming chip. If the gaming chip was not the last gaming chip, the process returns to block 1104. Otherwise, the process ends at block 1128.

Figure 12A:
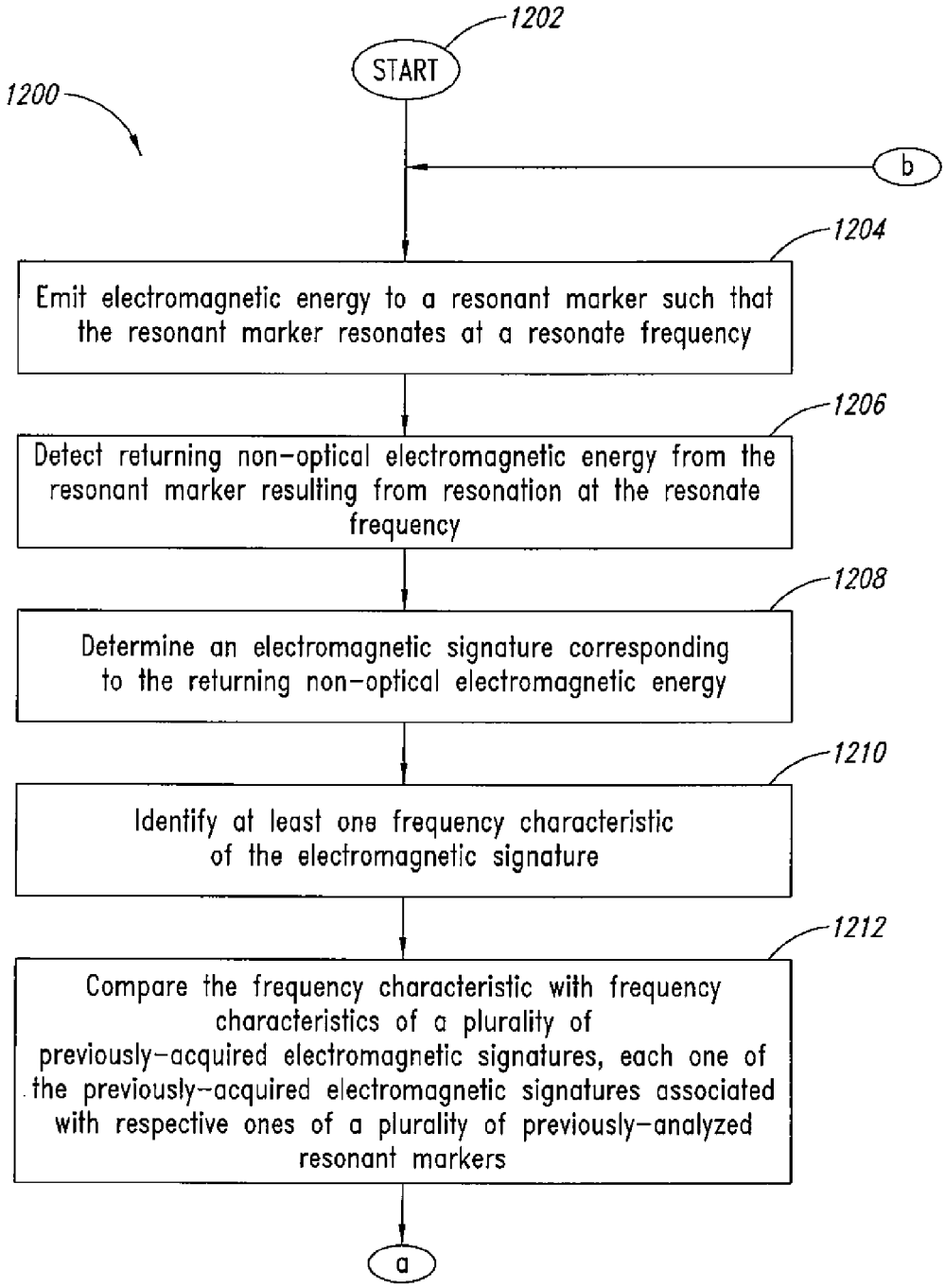
FIGS. 12A and 12B are a flowchart illustrating an embodiment of a process for uniquely identifying a plurality of resonant markers.
Figure 12B:
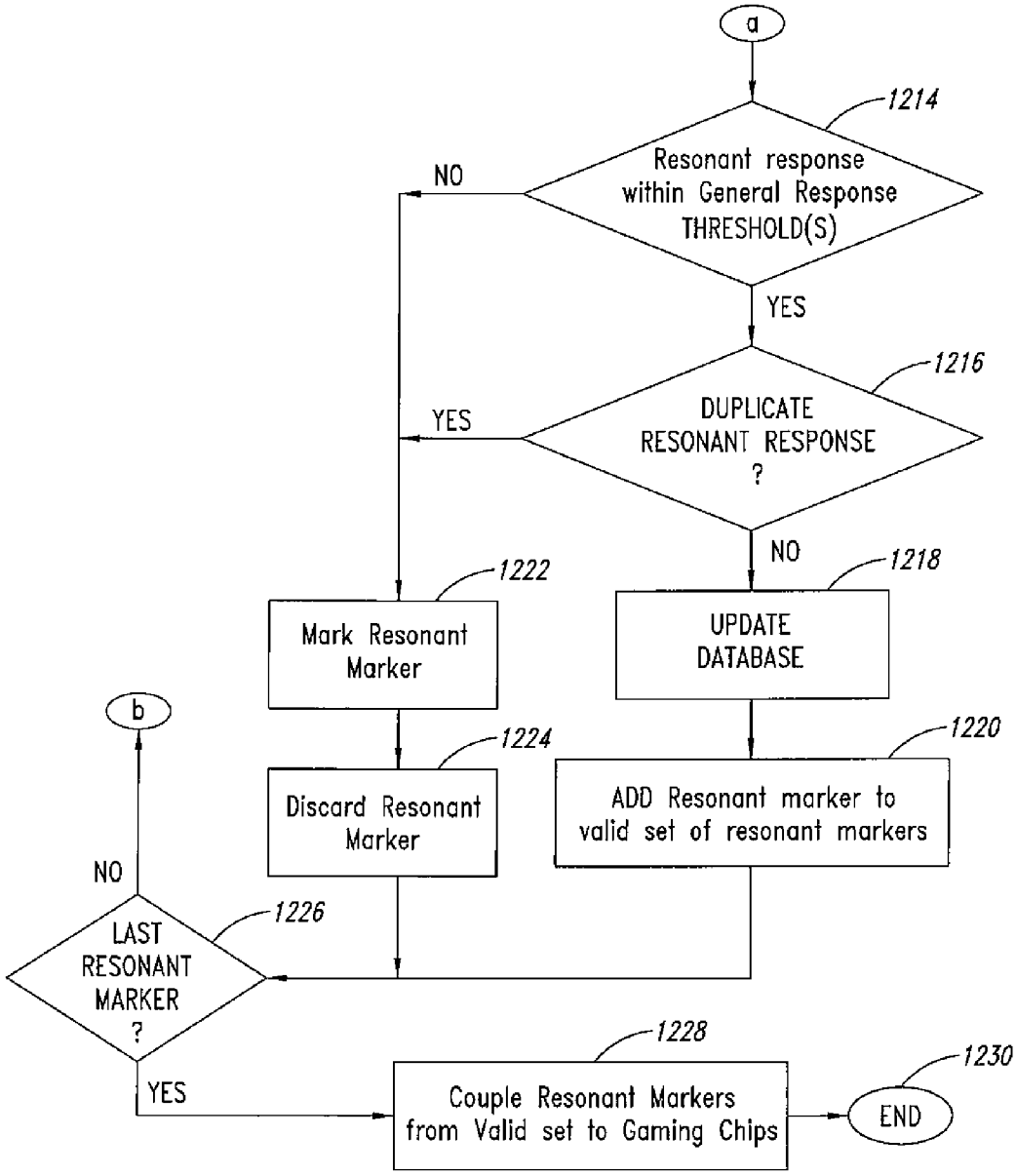

FIGS. 12A and 12B make up a flowchart 1200 illustrating an embodiment of a process for uniquely identifying a plurality of resonant markers. The process starts at block 1202. At block 1204, electromagnetic energy is emitted to a resonant marker such that the resonant marker resonates at a resonant frequency. At block 1206, non-optical electromagnetic energy from the resonant marker resulting from resonation at the resonant frequency is detected. At block 1208, an electromagnetic signature corresponding to the returning non-optical electromagnetic energy is determined. At block 1210, at least one frequency characteristic of the electromagnetic signature is identified. At block 1212, the frequency characteristic is compared with frequency characteristics of a plurality of previously-acquired electromagnetic signatures, each one of the previously-acquired electromagnetic signatures uniquely associated with one of a plurality of previously-analyzed resonant markers. At block 1214, a determination is made as to whether the resonant response is within a general response threshold or thresholds. If the resonant response is within a general response threshold or thresholds, the process continues at block 1216. Otherwise, the process continues at block 1222. At block 1216, a determination is made as to whether the resonant response is a duplicate resonant response. If the resonant response is not a duplicate resonant response, the process continues at block 1218. Otherwise, the process continues at block 1222. At block 1218, the electromagnetic signature database is updated. At block 1220, the resonant is added to the set of valid resonant markers. At block 1222, the resonant marker is marked, and at block 1224, the resonant marker is discarded. At 1226, a determination is made as to whether the resonant marker was the last resonant marker. If the resonant marker was not the last resonant marker, the process returns to block 1204. Otherwise, the continues at block 1228. At block 1228, resonant markers from the set of valid resonant markers are coupled to gaming chips. The process ends at block 1230

Figure 13A:
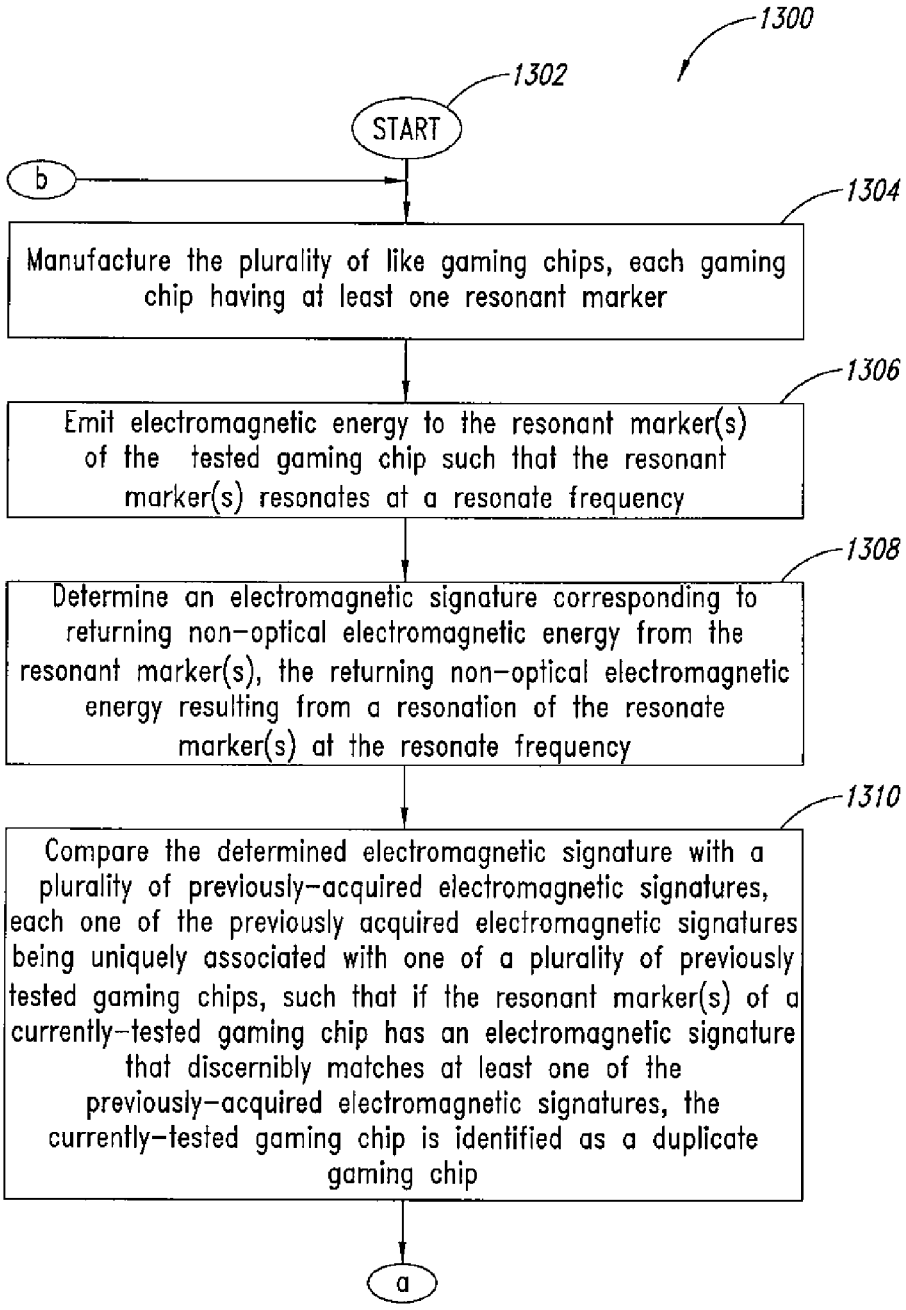
FIGS. 13A and 13B are a flowchart illustrating an embodiment of a process for manufacturing a plurality of gaming chips with resonant markers, wherein the plurality of gaming chips are uniquely identifiable.
Figure 13B:
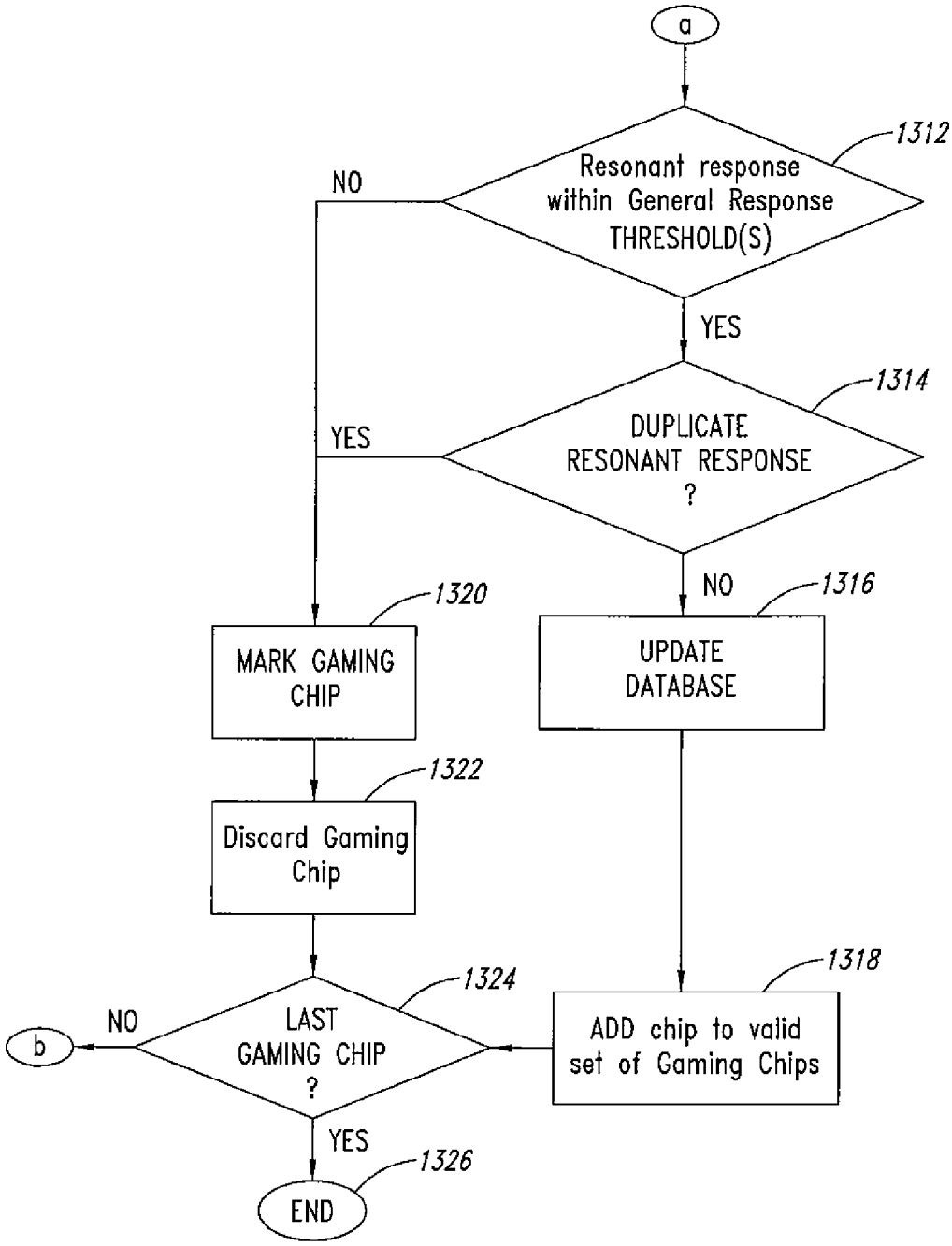

FIGS. 13A and 13B make up a flowchart 1300 illustrating an embodiment of a process for manufacturing a plurality of gaming chips with resonant markers, wherein the plurality of gaming chips are uniquely identifiable. The process starts at block 1302. At block 1304, the plurality of like gaming chips are manufactured, each gaming chip having at least one resonant marker. The gaming chips are tested as follows. At block 1306, electromagnetic energy is emitted to the resonant marker(s) of the tested gaming chip such that the resonant marker (s) resonates at a resonant frequency. At block 1308, an electromagnetic signature is determined corresponding to returning non-optical electromagnetic energy from the resonant marker(s), the returning non-optical electromagnetic energy resulting from a resonation of the resonant marker(s) at the resonant frequency. At block 1310, the determined electromagnetic signature is compared with a plurality of previously-acquired electromagnetic signatures, each one of the previously acquired electromagnetic signatures being uniquely associated with one of a plurality of previously tested gaming chips, such that if the resonant marker(s) of a currently-tested gaming chip has an electromagnetic signature that discernibly matches at least one of the previously-acquired electromagnetic signatures, the currently-tested gaming chip is identified as a duplicate gaming chip. At block 1312, a determination is made as to whether the resonant response is within a general response threshold or thresholds. If the resonant response is within a general response threshold or thresholds, the process continues at block 1314. Otherwise, the process continues at block 1320. At block 1314, a determination is made as to whether the resonant response is a duplicate resonant response. If the resonant response is not a duplicate resonant response, the process continues at block 1316. Otherwise, the process continues at block 1320. At block 1316, the electromagnetic signature database is updated. At block 1318, the gaming chip is added to the set of valid gaming chips. At block 1320, the gaming chip is marked, and at block 1322, the gaming chip is discarded. At 1324, a determination is made as to whether the gaming chip was the last gaming chip. If the gaming chip was not the last gaming chip, the process returns to block 1304. Otherwise, the process ends at block 1326.

Figure 14A:
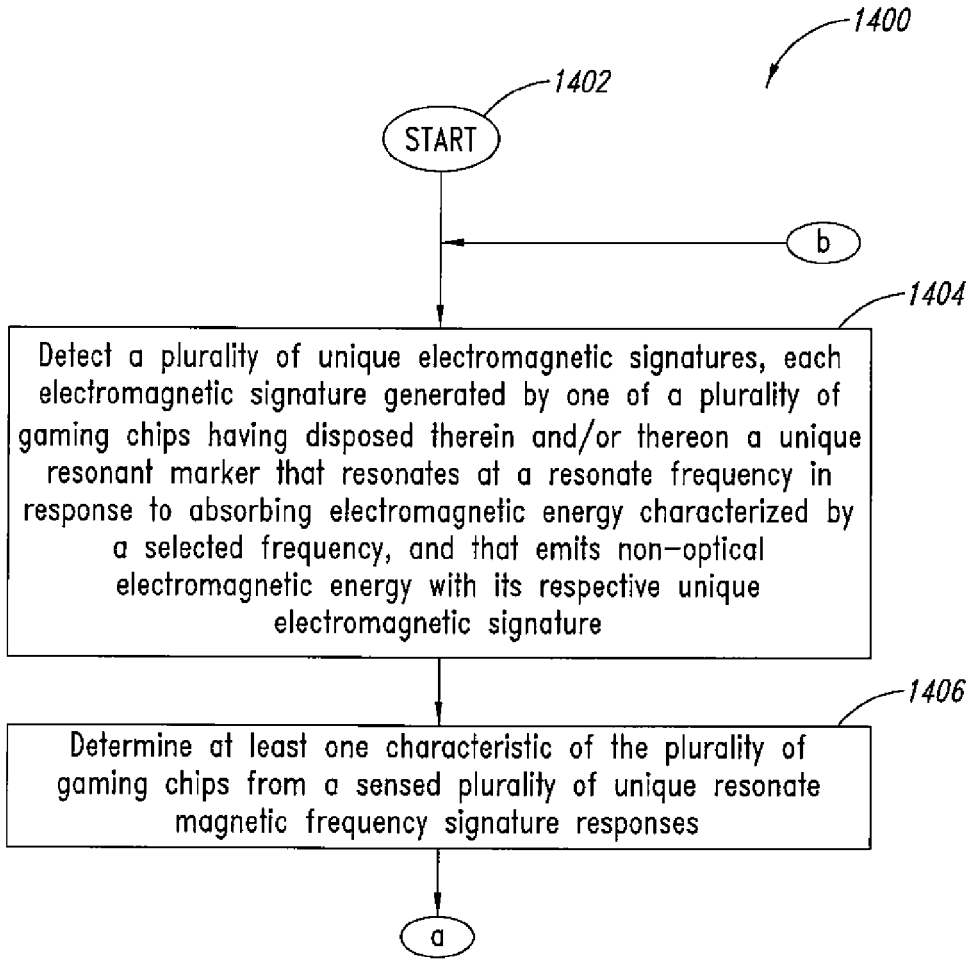
FIGS. 14A and 14B are a flowchart illustrating an embodiment of a process for uniquely identifying a plurality of gaming chips.
Figure 14B:
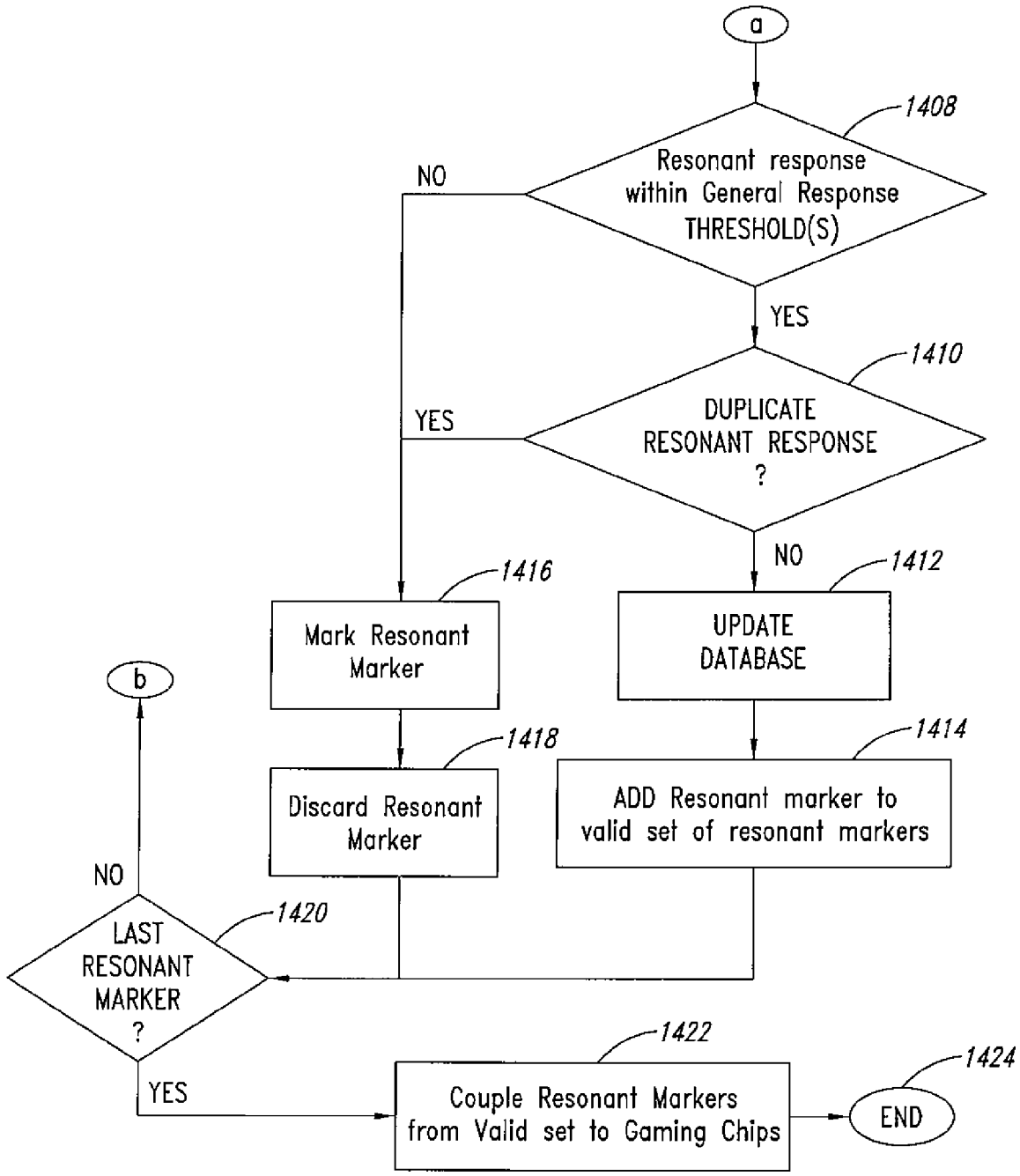

FIGS. 14A and 14B make up a flowchart 1400 illustrating an embodiment of a process for uniquely identifying a plurality of gaming chips. The process starts at block 1402. At block 1404, a plurality of unique electromagnetic signatures is detected, each electromagnetic signature generated by one of a plurality of gaming chips having disposed therein and/or thereon a unique resonant marker that resonates at a resonant frequency in response to absorbing electromagnetic energy characterized by a selected frequency, and that emits non-optical electromagnetic energy with its respective unique electromagnetic signature. At block 1406, at least one characteristic of the plurality of gaming chips is determined from a sensed plurality of unique resonant magnetic frequency signature responses. At block 1408, a determination is made as to whether the resonant response is within a general response threshold or thresholds. If the resonant response is within a general response threshold or thresholds, the process continues at block 1410. Otherwise, the process continues at block 1416. At block 1410, a determination is made as to whether the resonant response is a duplicate resonant response. If the resonant response is not a duplicate resonant response, the process continues at block 1412. Otherwise, the process continues at block 1416. At block 1412, the electromagnetic signature database is updated. At block 1414, the resonant is added to the set of valid resonant markers. At block 1416, the resonant marker is marked, and at block 1418, the resonant marker is discarded. At 1420, a determination is made as to whether the resonant marker was the last resonant marker. If the resonant marker was not the last resonant marker, the process returns to block 1404. Otherwise, the continues at block 1422. At block 1422, resonant markers from the set of valid resonant markers are coupled to gaming chips. The process ends at block 1424.

When electromagnetic signature analysis logic 132 (FIG. 1) is implemented as software and stored in memory 128, one skilled in the art will appreciate that the electromagnetic signature analysis logic 132 can be stored on any computer-readable medium for use by or in connection with any computer and/or processor related system or method. In the context of this document, a memory 128 is a computer-readable medium that is an electronic, magnetic, optical, or another physical device or means that contains or stores a computer and/or processor program. The electromagnetic signature analysis logic 132 can be embodied in any computer-readable medium for use by or in connection with an instruction execution system, apparatus, or device, such as a computer-based system, processor-containing system, or other system that can fetch the instructions from the instruction execution system, apparatus, or device and execute the instructions associated with the electromagnetic signature analysis logic 132. In the context of this specification, a "computer-readable medium" can be any means that can store, communicate, propagate, or transport the program associated with logic 908 for use by or in connection with the instruction execution system, apparatus, and/or device. The computer-readable medium can be, for example, but is not limited to, an electronic, magnetic, optical, electromagnetic, infrared, or semiconductor system, apparatus, device, or propagation medium. More specific examples (a nonexhaustive list) of the computer-readable medium would include the following: an electrical connection having one or more wires, a portable computer diskette (magnetic, compact flash card, secure digital, or the like), a random access memory (RAM), a read-only memory (ROM), an erasable programmable read-only memory (EPROM, EEPROM, or Flash memory), an optical fiber, and a portable compact disc read-only memory (CDROM). Note that the computer-readable medium could even be paper or another suitable medium upon which the program associated with the electromagnetic signature analysis logic 132 is printed, as the program can be electronically captured, via for instance optical scanning of the paper or other medium, then compiled, interpreted, or otherwise processed in a suitable manner, if necessary, and then stored in memory 128.

ALTERNATIVE EMBODIMENTS

To further increase the number of possible members of a group of resonant markers 112 which are responsive to a preselected frequency or frequency range, variations in dimensions, material compositions, and/or shape may be intentionally introduced during the manufacturing process of resonant markers 112. For example, dimensions of the magnetic material in a magnetic type resonant marker 112 may be intentionally altered. Dimensions and/or shape of the wire used in a RLC type resonant marker 112 may be intentionally altered. Dimensions and/or shape of the cavity used in a cavity type resonant marker 112 may be intentionally altered. Dimensions and/or shape of openings to the cavity used in a cavity type resonant marker 112 may be intentionally altered. Locations of openings to the cavity used in a cavity type resonant marker 112 may be intentionally altered. Material properties may be intentionally altered. In a cavity type resonator maker, material may be introduced. It is appreciated that the possible variations to a resonant marker 112 are too numerous to conveniently describe herein. So long as the altered resonant marker 112 is responsive to the frequency range of the emitted electromagnetic energy 116 such that the resonant marker 112 absorbs a portion of the emitted electromagnetic energy 116 at its resonant frequency, the altered resonant marker 112 will be suitable for inclusion within a group of resonant markers (or a group of gaming chips 104).

As an example, circuit board fabrication and/or integrated circuit fabrication and lithography techniques may be used to form a group of RLC type resonant markers 112 that are generally responsive to the frequency or frequency range of the emitted electromagnetic energy 116. Slight variations in the shape or form of the resonant markers 112 may be induced during circuit fabrication such that the above-described unique electromagnetic signatures 124 result.

It is appreciated that other characteristics of a gaming chip 104 may be used to differentiate the gaming chip. For example, different size and/or shape of the gaming chip 104 may correspond to value. If increasing gaming chip size and/or shape is associated with increasing value, the change in dimensions from one denomination gaming chip to the next denomination chip may be used to change the resonation characteristics of a resonant type marker 112.

Figure 15:
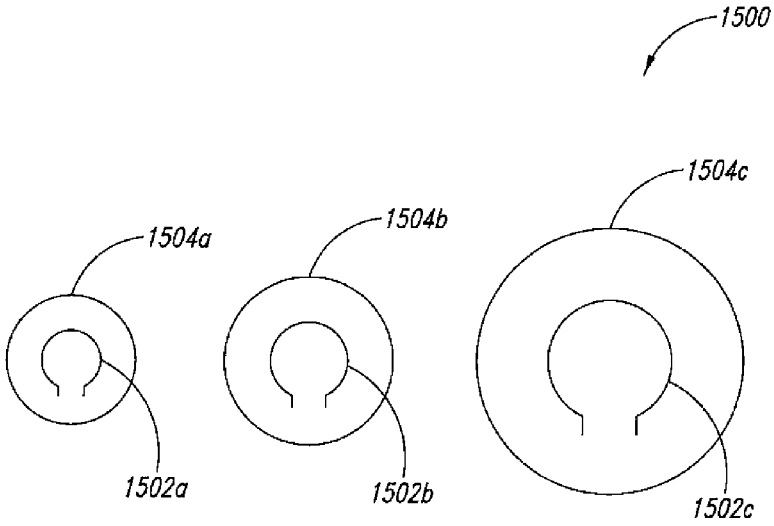
FIG. 15 is a block diagram illustrating a plurality of gaming chips of different diameters, each having an inductive coil formed therein.

FIG. 15 is a block diagram illustrating a plurality of gaming chips 1500 of different diameters, each having an inductive coil 1502*a-c* formed therein. As the diameter of the gaming chips 1504*a-c* increases, the diameter of corresponding inductive coil 1502*a-c* increases. The changing diameters of the inductive coils 1502*a-c* results in a change in the equivalent RLC circuit 200 (FIG. 2) which characterizes the electrical properties of an RLC type resonant marker 112. Accordingly, the resonation characteristics of the RLC type resonant type marker 112 change as the diameter of the gaming chips 1504*a-c* change.

Figure 16:
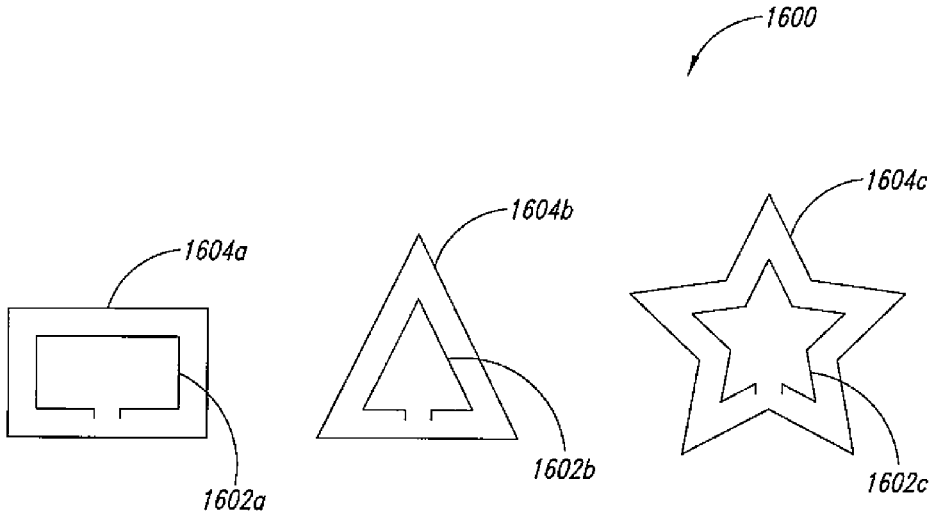
FIG. 16 is a block diagram illustrating a plurality of gaming chips of different shapes, each having an inductive coil formed therein.

FIG. 16 is a block diagram illustrating a plurality of gaming chips 1600 of different shapes, each having an inductive coil 1602*a-c* formed therein. As the shape of the gaming chips 1604*a-c* change, the shape of corresponding inductive coils 1602*a-c* changes. This changing shape of the inductive coil 1602*a-c* results in a change in the equivalent RLC circuit 200 (FIG. 2) which characterizes the electrical properties of an RLC type resonant marker 112. Accordingly, the resonation characteristics of the RLC type resonant type marker 112 change as shape of the gaming chips 1604*a-c* change.

Figure 17:
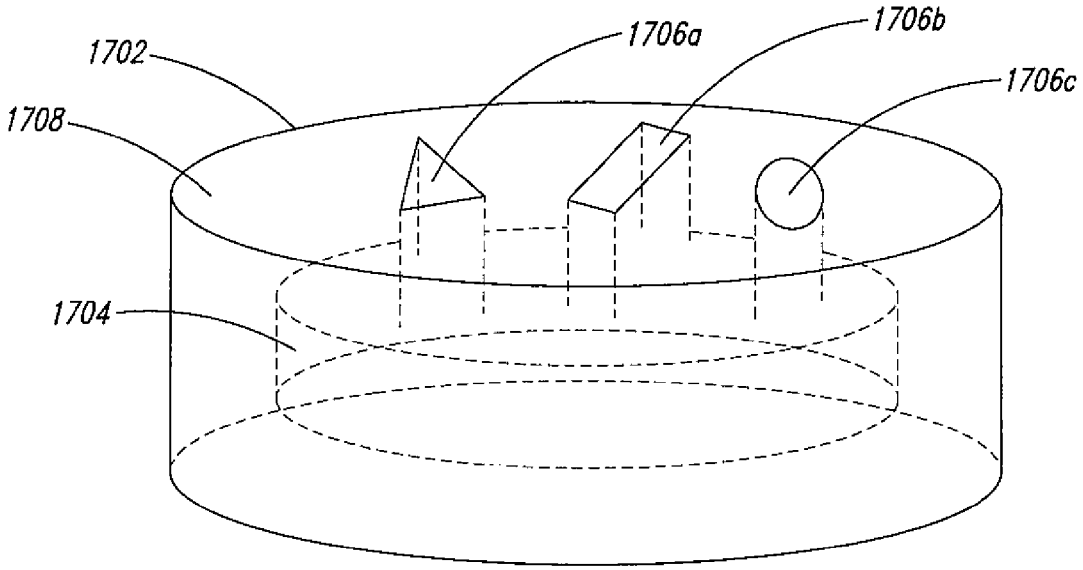
FIG. 17 is an isometric view of a gaming chip having at least one opening and a cavity formed therein.

FIG. 17 is an isometric view of a gaming chip 1702 having a cavity 1704 formed therein. A plurality of openings 1706*a-d* extend from a face 1708 of the gaming chip 1702 to the cavity 1706. In the embodiment illustrated, the openings 1706*a-d* have varying shapes. In some embodiments, the openings 1706*a-d* may have the same shape. Changing the shape and/or dimensions of the cavity 1704 changes the resonance frequency of the gaming chip 1702. Accordingly, the resonation characteristics of the cavity type resonant type marker change as the shape and/or dimensions of the cavity 1704 changes. Similarly, electromagnetic energy released by the gaming chip 1702 is a function of, among other things, the number of openings 1706*a-d*, the sizes of the respective openings 1706*a-d*, the relative locations of the openings 1706*a-d* with respect to each other, and the relative locations of the openings 1706*a-d* with respect to the gaming chip 1702.

Figure 18:
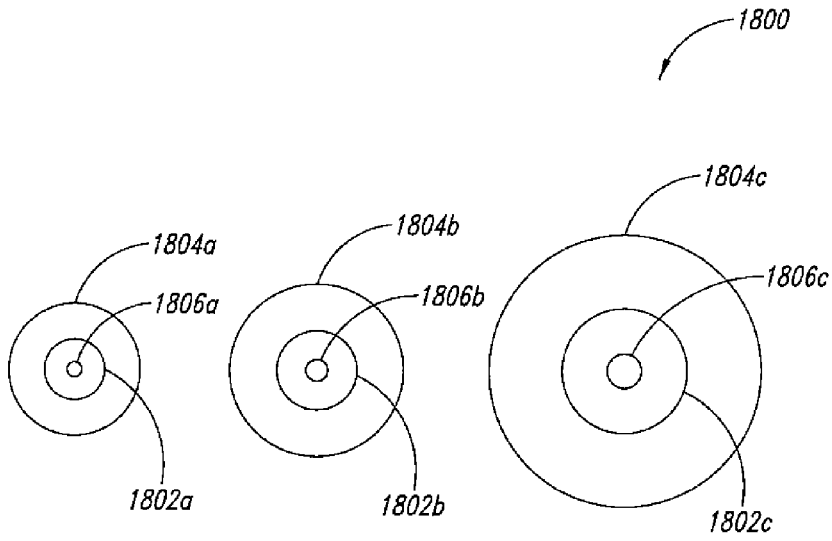
FIG. 18 is a block diagram illustrating a plurality of gaming chips of different diameters, each having a cavity formed therein.

FIG. 18 is a block diagram illustrating a plurality of gaming chips 1800 of different diameters, each having a cavity 1802*a-c* formed therein. As the diameter of the gaming chips 1804*a-c* increases, the diameter of corresponding cavity 1802*a-c* increases. Accordingly, the resonation characteristics of the cavity type resonant type marker 112 change as the diameter of the gaming chips 1804*a-c* change.

In some embodiments, the gaming chips 1800 may include one or more openings 1806*a-c*, which extend from a surface to the respective cavity 1802*a-c*. As the diameter of the gaming chips 1804*a-c* increases, the diameter of corresponding opening 1806*a-c* increases. Accordingly, the resonation characteristics of the cavity type resonant type marker 112 change as the diameter of the opening 1806*a-c* increases.

Figure 19:
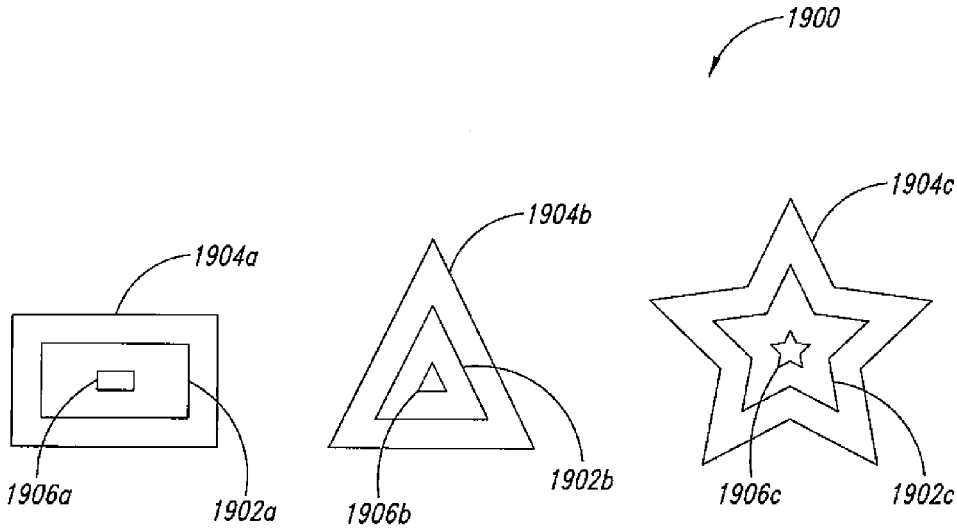
FIG. 19 is a block diagram illustrating a plurality of gaming chips of different shapes, each having a cavity formed therein.

FIG. 19 is a block diagram illustrating a plurality of gaming chips 1900 of different shapes, each having a cavity 1902 formed therein. As the shape of the gaming chips 1904*a-c* change, the shape of corresponding cavities 1902*a-c* changes. Accordingly, the resonation characteristics of the cavity type resonant type marker 112 change as shape of the gaming chips 1900 change.

In some embodiments, the gaming chips 1900 may include one or more openings 1906*a-c*, which extend from a surface to the respective cavity 1802*a-c*. As the shape of the gaming chips 1904*a-c* varies, the shape of corresponding opening 1906*a-c* varies. Accordingly, the resonation characteristics of the cavity type resonant type marker 112 change as the shape of the opening 1906*a-c* change.

Figure 20:
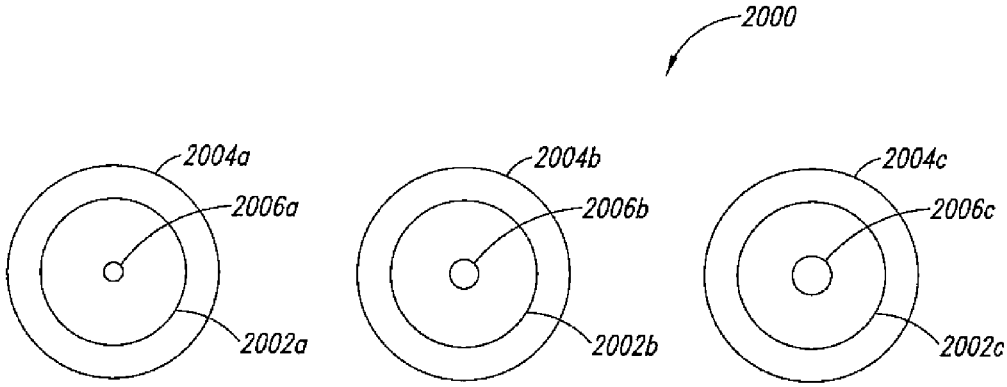
FIG. 20 is a block diagram illustrating a plurality of gaming chips of equal diameters, each having a cavity formed therein, and each having openings of different diameters.

FIG. 20 is a block diagram illustrating a plurality of gaming chips 2000 of equal diameter, each having a cavity 2002*a-c* formed therein. The cavities 2002*a-c* are of equal size and shape. Each one of the gaming chips 2000 include one or more openings 2006*a-c*, which extend from a surface to the respective cavity 2002*a-c*. The shapes of the openings 2006*a-c* are similar or the same, but the sizes of the openings 2006*a-c* are different with opening 2006*a* being the smallest and opening 2006*c* being the largest. Accordingly, the resonation characteristics of the cavity type resonant type marker 112 change as the size of the openings 2006*a-c* increases.

Figure 21:
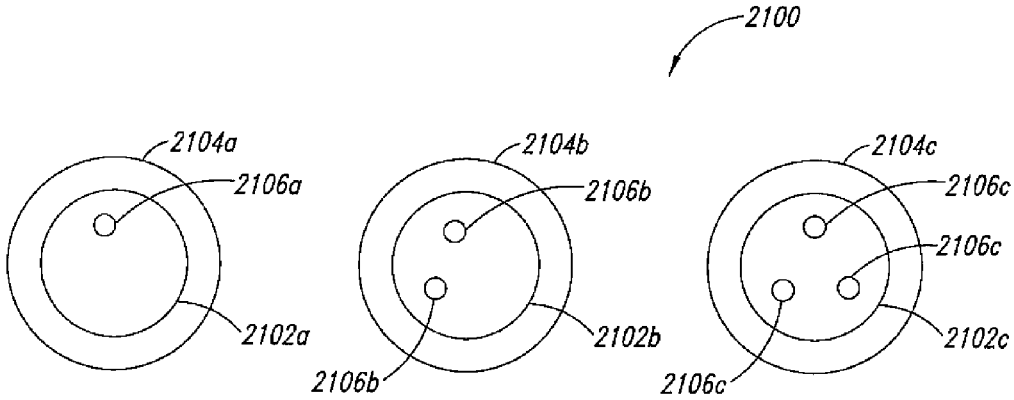
FIG. 21 is a block diagram illustrating a plurality of gaming chips of equal diameters, each having a cavity formed therein, and each having a different number of openings.

FIG. 21 is a block diagram illustrating a plurality of gaming chips 2100 of equal diameter, each having a cavity 2102*a-c* formed therein. The cavities 2102*a-c* are of equal size and shape. Each one of the gaming chips 2100 include one or more openings 2106*a-c*, which extend from a surface to the respective cavity 2102*a-c*. The sizes and shapes of the openings 2106*a-c* are similar or the same, but the number of respective openings is different. Accordingly, the resonation characteristics of the cavity type resonant type marker 112 change as the number of the openings 2106*a-c* increases.

Figure 22:
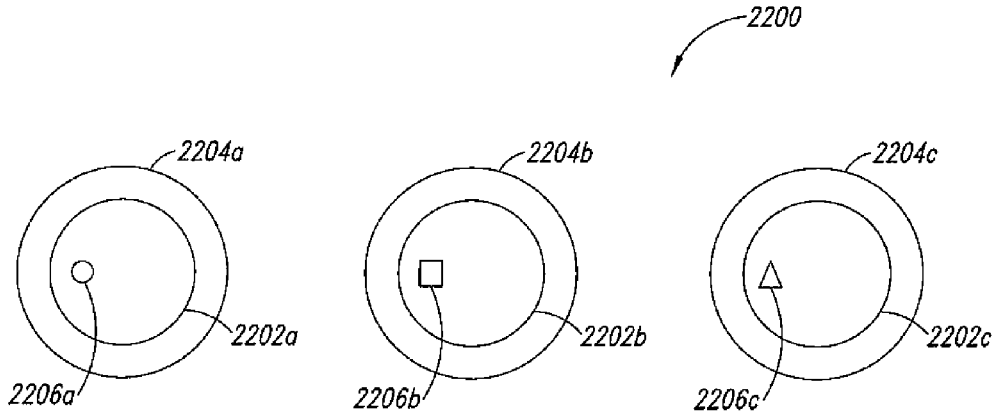
FIG. 22 is a block diagram illustrating a plurality of gaming chips of equal diameters, each having a cavity formed therein, and each having different shaped openings.

FIG. 22 is a block diagram illustrating a plurality of gaming chips 2200 of equal diameter, each having a cavity 2202*a-c* formed therein. The cavities 2202*a-c* are of equal size and shape. Each one of the gaming chips 2200 include one or more openings 2206*a-c*, which extend from a surface to the respective cavity 2202*a-c*. Each respective opening 2206*a-c* has a shape that is different from the other openings. Accordingly, the resonation characteristics of the cavity type resonant type marker 112 change as the shape of the openings 2206*a-c* changes.

Figure 23:
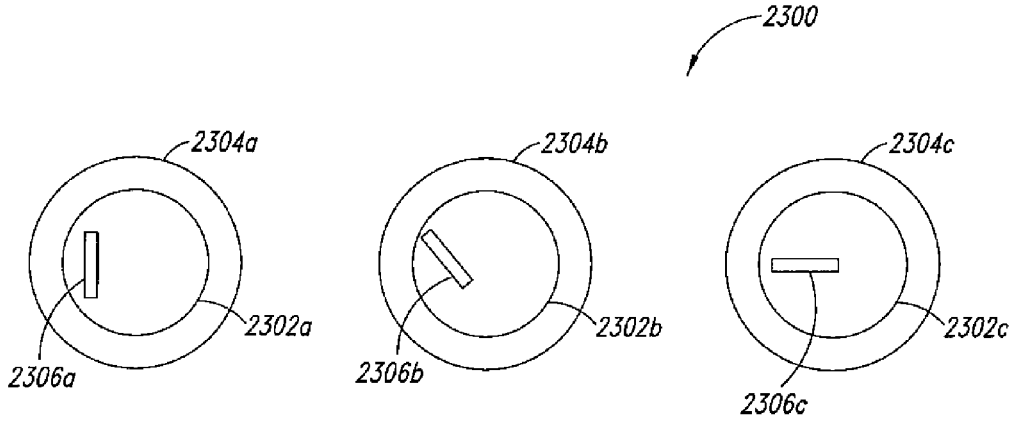
FIG. 23 is a block diagram illustrating a plurality of gaming chips of equal diameters, each having a cavity formed therein, and each having openings that are orientated differently.

FIG. 23 is a block diagram illustrating a plurality of gaming chips 2300 of equal diameter, each having a cavity 2302*a-c* formed therein. The cavities 2302*a-c* are of equal size and shape. Each one of the gaming chips 2300 include one or more openings 2306*a-c*, which extend from a surface to the respective cavity 2302*a-c*. The openings 2306*a-c* have similar or the same shape and similar or the same size. The respective openings 2306*a-c* are orientated differently. Accordingly, the resonation characteristics of the cavity type resonant type marker 112 change as the orientations of the openings 2306*a-c* changes.

Furthermore, a plurality of resonant markers 112 may be embedded within a single gaming chip 104 such that each gaming chip 104 produces a plurality of different electromagnetic signatures. The plurality of resonant markers 112 may be magnetic type and/or RLC type and/or cavity type. Since each resonant marker 112 will have its own unique electromagnetic signature 124, the returned electromagnetic energy 120 detected by receiver 108 will be comprised of the plurality of unique electromagnetic signatures 124. Using a plurality of resonant markers will increase the possible maximum number of group members which may be uniquely identifiable since more variations are possible.

When a plurality of gaming chips 104 having resonant markers 112 are in an interrogation zone 114, the plurality of electromagnetic signatures 124 are identifiable. Accordingly, the plurality of individual gaming chips 104, and/or their associated resonant markers 112, are identifiable. Further, the quantity of the individual gaming chips 104 in the interrogation zone are determinable. If value information is associated with the identifier, the value of the plurality of gaming chips 104 is determinable.

Furthermore, assuming the location of the gaming chip identification system 102 is known, the location of gaming chips 104 having resonant markers 112 are determinable when they are determined to be in an interrogation zone 114 of known location.

Using multiple antennas to define a single interrogation zone 114 allows determination of the location of the gaming chips 104 in the interrogation zone 114. Various embodiments may use one or more transmitters 106 and/or one or more receivers 108 to triangulate the location of the gaming chip 104.

As described herein, the emitted electromagnetic energy 116, the returned electromagnetic energy 120 and the electromagnetic signature 124 are associated with electromagnetic energy. In various embodiments, the frequency or frequency range of the electromagnetic energy is in the extremely high frequency (EHF) range from thirty (30) to three hundred (300) gigahertz (GHz) range. In one embodiment, the electromagnetic energy is in the radar frequency range of 50-60 GHz. Any suitable electromagnetic frequency or frequency range may be used by the various embodiments.

As noted above, embodiments of the gaming chip identification system 102 (FIG. 1) may be used at a variety of locations for a variety of purposes. Exemplary locations include, but are not limited to, an entryway or exit, a cashier's cage, a counting room, or a gaming table. The effective size of the interrogation zone 114 may be controllable by the strength and/or frequency of the emitted electromagnetic energy 116, by the nature of the resonant marker 112, and/or by the relative locations of the transmitter 106 and the receiver 108 to each other and to the resonant marker 112. The possible applications of various embodiments of the gaming chip identification system 102, the physical configuration of the components, and/or the size of the interrogation zone 114, are too numerous to conveniently describe herein. All such variations and/or embodiments are intended to be within the scope of this disclosure.

Since it is very probable that a plurality of gaming chip identification systems 102 (FIG. 1) will be deployed at a variety of locations for a variety of purposes within a gaming establishment, the determined electromagnetic signature for any particular resonant marker 112 should be repeatable. That is, independent of which one of a plurality of different transmitters 106 are emitting the electromagnetic energy 116 and independent of which one of a plurality of different receivers 108 are detecting the returned electromagnetic energy 120, the determined electromagnetic signature 124 should be the same (or substantially the same), such that the unique characteristics of the electromagnetic signature 124 are discernable.

Furthermore, with respect to a plurality of gaming chip identification systems 102, the individual components used in any particular gaming chip identification system 102 need not be identical to those corresponding components in other gaming chip identification systems 102. For example, individual gaming chip identification systems 102 may be made and/or sold by different vendors. So long as the emitted electromagnetic energy 116 is substantially similar, different embodiments of the gaming chip identification system 102 will determine substantially similar electromagnetic signatures 124.

In one aspect, a gaming chip identification system includes an embodiment for facilitating wagering. The embodiment comprises a plurality of gaming chips, each gaming chip operable to emit a respective unique electromagnetic signature in response to incident non-optical electromagnetic radiation, a computer-readable medium that stores information indicative of the electromagnetic signatures of at least a number of the plurality of gaming chips, and a processor-based system configured to verify that the electromagnetic signature from an interrogated gaming chip in an interrogation zone is a member of the plurality of gaming chips.

In another aspect, a gaming chip identification system includes an embodiment for verifying gaming chips. The embodiment comprises at least a first antenna, a transmitter communicatively coupled to at least the first antenna and operable to transmit non-optical electromagnetic energy therefrom, a receiver operable to detect respective electromagnetic signatures from each of a plurality of gaming chips, a processor-readable memory that stores processor-executable instructions to compare a respective representation of at least some of the electromagnetic signatures with representations of previously detected electromagnetic signatures, and to provide indications that the gaming chips having the electronic signatures are within one of the previously-detected electronic signatures, and a processor communicatively coupled to the memory and operable to execute the processor-executable instructions stored in the memory.

In yet another aspect, a gaming chip identification system includes an embodiment for uniquely identifying a plurality of like gaming chips with resonant markers. The embodiment comprises a transmitter that emits non-optical electromagnetic energy to one of the resonant markers such that the resonant marker resonates at a resonant frequency; a receiver that detects returned non-optical electromagnetic energy from the resonant marker resulting from the resonation at the resonant frequency, wherein the returned non-optical electromagnetic energy is generated by the resonant marker in response to receiving the non-optical electromagnetic energy from the transmitter, and that generates a signal corresponding to the returned non-optical electromagnetic energy; and a processing system communicatively coupled to the receiver, that receives the signal from the receiver, that determines an electromagnetic signature from the signal, and that compares the determined electromagnetic signature with a plurality of stored electromagnetic signatures residing in a database such that when the electromagnetic signature discernibly matches one of the stored electromagnetic signatures, the gaming chip is identified as a duplicate gaming chip.

In yet another aspect, a gaming chip identification system includes an embodiment for uniquely identifying a plurality of like gaming chips with resonant markers. The embodiment is a method comprising emitting electromagnetic energy to the resonant marker associated with a gaming chip such that the resonant marker resonates at a resonant frequency, receiving returning non-optical electromagnetic energy from the resonant marker resulting from resonation at the resonant frequency, determining an electromagnetic signature corresponding to the returning non-optical electromagnetic energy, identifying at least one frequency characteristic of the electromagnetic signature, and comparing the identified frequency characteristic with frequency characteristics of a plurality of previously-acquired electromagnetic signatures, each one of the previously-acquired electromagnetic signatures uniquely associated with one of a plurality of previously-analyzed resonant markers.

In yet another aspect, a gaming chip identification system includes an embodiment for uniquely identifying a plurality of resonant markers. The embodiment is a method comprising emitting electromagnetic energy to a resonant marker such that the resonant marker resonates at a resonant frequency, detecting returning non-optical electromagnetic energy from the resonant marker resulting from resonation at the resonant frequency, determining an electromagnetic signature corresponding to the returning non-optical electromagnetic energy, identifying at least one frequency characteristic of the electromagnetic signature, and comparing the frequency characteristic with frequency characteristics of a plurality of previously-acquired electromagnetic signatures, each one of the previously-acquired electromagnetic signatures uniquely associated with one of a plurality of previously-analyzed resonant markers.

In yet another aspect, a gaming chip identification system includes an embodiment for manufacturing a plurality of gaming chips with resonant markers, wherein the plurality of gaming chips are uniquely identifiable. The embodiment is a method comprising manufacturing the plurality of like gaming chips, each gaming chip having at least one resonant marker; and sequentially testing each gaming chip. Gaming chip testing comprises emitting electromagnetic energy to the resonant marker of the tested gaming chip such that the resonant marker resonates at a resonant frequency; determining an electromagnetic signature corresponding to returning non-optical electromagnetic energy from the resonant marker, the returning non-optical electromagnetic energy resulting from a resonation of the resonant marker at the resonant frequency; and comparing the determined electromagnetic signature with a plurality of previously-acquired electromagnetic signatures, each one of the previously acquired electromagnetic signatures being uniquely associated with one of a plurality of previously tested gaming chips, such that if the resonant marker of a currently-tested gaming chip has an electromagnetic signature that discernibly matches at least one of the previously-acquired electromagnetic signatures, the currently-tested gaming chip is identified as a duplicate gaming chip.

In yet another aspect, a gaming chip identification system includes an embodiment for identifying individual gaming chips in a group of gaming chips. The embodiment comprises at least a first gaming chip having a first resonant marker that resonates at a resonant frequency in response to absorbing electromagnetic energy characterized by a selected frequency, and that emits non-optical electromagnetic energy with a first unique electromagnetic signature; and at least a second gaming chip having a second resonant marker that resonates at the resonant frequency in response to absorbing the electromagnetic energy characterized by the selected frequency, and that emits non-optical electromagnetic energy with a second unique electromagnetic signature, wherein the first unique electromagnetic signature and the second unique electromagnetic signature are discernibly different.

In yet another aspect, a gaming chip identification system includes an embodiment for uniquely identifying a plurality of gaming chips. The embodiment is a method comprising detecting a plurality of unique electromagnetic signatures, each electromagnetic signature generated by one of a plurality of gaming chips having disposed therein a unique resonant marker that resonates at a resonant frequency in response to absorbing electromagnetic energy characterized by a selected frequency, and that emits non-optical electromagnetic energy with its respective unique electromagnetic signature; and determining at least one characteristic of the plurality of gaming chips from a sensed plurality of unique resonant magnetic frequency signature responses.

The various embodiments described above can be combined to provide further embodiments. All of the above U.S. patents, patent applications, provisional patent applications, and publications referred to in this specification to include, but not be limited to, U.S. Pat. No. 5,651,548 to French at al.; U.S. Pat. No. 3,766,452 to Burpee et al.; U.S. Pat. No. 4,510,490 to Anderson, III et al.; U.S. Pat. No. 5,406,264 to Plonsky et al.; U.S. Pat. No. 4,660,025 to Humphrey; and U.S. Pat. No. 4,859,991 to Watkins et al., which are incorporated herein by reference in their entirety. Embodiments can be modified, if necessary, to employ various systems, devices, and concepts of the various patents, applications, and publications to provide yet further embodiments of the invention.

These and other changes can be made to the invention in light of the above-detailed description. In general, in the following claims, the terms used should not be construed to limit the invention to the specific embodiments disclosed in the specification and the claims, but should be construed to include all gaming chip identification devices and systems, and the operational aspects that operate in accordance with the claims. Accordingly, the invention is not limited by the disclosure, but instead its scope is to be determined entirely by the following claims.

The invention claimed is:

1. A system to facilitate wagering, the system comprising:

at least one transmitter operable to emit non-optical electromagnetic energy via at least one antenna;

at least one receiver operable to receive a resonant response from memoryless gaming chips which do not store identification information within a range of the emitted non-optical electromagnetic energy via the at least one antenna;

wherein each memoryless gaming chip includes a respective resonant marker configured to emit a respective unique resonant response in response to incident non-optical electromagnetic radiation; and, the resonant markers of each of a first plurality of gaming chips being identical to each other within a defined manufacturing tolerance for the resonant marker and being different from each other beyond the defined manufacturing tolerance for the resonant marker;

a non-transitory computer-readable medium that stores information indicative of at least one resonant response of a valid set of gaming chips, each of the at least one resonant response comprising a respective electromagnetic signature characterized by sustained electromagnetic oscillations at one or more frequencies; and at least one processor programmed to determine whether a gaming chip is from the valid set based at least in part on a received resonant response comprising a respective electromagnetic signature characterized by sustained electromagnetic oscillations at one or more frequencies.

2. The system of claim 1, wherein the computer-readable medium stores information indicative of a first resonant response of a first subset of the valid set of gaming chips and a second resonant response of a second subset of the gaming chips, the gaming chips of the first subset bearing indicia of a first denomination and the gaming chips of the second subset bearing indicia of a second denomination, and wherein the at least one processor is further programmed to determine a denomination of the gaming chip based at least in part on the received resonant responses.

3. The system of claim 1 wherein the computer-readable medium stores information indicative of a unique resonant response of each of the gaming chips in the valid set of gaming chips, and wherein the at least one processor is further programmed to uniquely identify the gaming chips from all other gaming chips in the set of valid gaming chips, based at least in part on the received resonant responses.

4. The system of claim 1, further comprising:

a first plurality of gaming chips of a first denomination, each of the gaming chips in the first plurality of gaming chips configured to emit a first resonant response in response to incident non-optical electromagnetic radiation, and a second plurality of gaming chips of a second denomination, each of the gaming chips in the second plurality of gaming chips configured to emit a second resonant response in response to incident non-optical electromagnetic radiation, the second resonant response discernibly different from the first resonant response.

5. The system of claim 1 wherein each of the gaming chips carries a resonant material.

6. The system of claim 1 wherein each of the gaming chips carries a resonant circuit.

7. The system of claim 1 wherein each of the gaming chips carries at least one resonant marker selected from the group consisting of: a magnetic type resonant marker, a resistor, inductor, capacitor type resonant marker, and a cavity type resonant marker.

8. The system of claim 7 wherein the resonant markers of the gaming chips in the first plurality of gaming chips has a first shape, and the resonant markers of the gaming chips in the second plurality of gaming chips has a second shape, the second shape different from the first shape.

9. The system of claim 7 wherein the resonant markers of the gaming chips in the first plurality of gaming chips has at least a first dimension of a first size, and the resonant markers of the second plurality of gaming chips has at least the first dimension of a second size, the second size different from the first size.

10. The system of claim 7 wherein the resonant markers of the gaming chips in the first plurality of gaming chips consist of a first material, and the resonant markers of the gaming chips in the second plurality of gaming chips consist of a second material, the second material different from the first material.

11. The system of claim 1, wherein the resonant marker of each of a second plurality of gaming chips being identical to each other within a defined manufacturing tolerance of the resonant marker and being different from each other beyond the defined manufacturing tolerance of the resonant marker; and, wherein the resonant markers of the first plurality of the gaming chips have a first shape and the resonant markers of the second plurality of the gaming chips have a second shape different from the first shape.

12. The system of claim 1, wherein the resonant marker of each of a second plurality of gaming chips being identical to each other within a defined manufacturing tolerance of the resonant marker and being different from each other beyond the defined manufacturing tolerance of the resonant marker; and wherein the resonant markers of the first plurality of the gaming chips have at least a first dimension of a first size, and the resonant markers of the second plurality of the gaming chips have at least the first dimension of a second size different from the first size.

13. The system of claim 1, wherein the resonant marker of each of a second plurality of gaming chips being identical to each other within a defined manufacturing tolerance of the resonant marker and being different from each other beyond the defined manufacturing tolerance of the resonant marker;

wherein the resonant markers of the first plurality of the gaming chips consist of a first material, and the resonant markers of the second plurality of the gaming chips consist of a second material different from the first material.

14. The system of claim 1 wherein the transmitter and the receiver share a common antenna.

15. The system of claim 1 wherein the transmitter and the receiver share a common antenna.

16. A system to form valid sets of gaming chips, comprising:

at least one transmitter operable to emit non-optical electromagnetic energy via at least one antenna;

at least one receiver operable to receive an unmodulated, resonant response from any memoryless resonant markers within a range of the emitted non-optical electromagnetic energy via the at least one antenna;

a non-transitory computer-readable medium operable to store information indicative of resonant responses from a plurality of resonant markers; and at least one processor programmed to determine whether received resonant responses from any of the resonant markers are discernibly distinct from the resonant responses of the plurality of resonant markers for which information indicative of the resonant responses has been previously stored in the computer-readable medium;

wherein the resonant markers resonate in response to one or more passive electrical components, resonating structures, or resonating materials absorbing non-optical electromagnetic energy and the resonant markers do not include active switches or active circuits; and store information indicative of the received, unmodulated, resonant response that lies within a defined manufacturing tolerance in the computer-readable medium if the received resonant response is discernibly distinct beyond the defined manufacturing tolerance from other resonant responses for which information indicative of the respective received, unmodulated, resonant response has previously been stored in the computer-readable medium.

17. The system of claim 16 wherein the at least one transmitter emits the non-optical electromagnetic energy over a period of time, wherein the non-optical electromagnetic energy is characterized by a frequency, and wherein the frequency of the non-optical electromagnetic energy is swept over a frequency range during the period of time.

18. The system of claim 16 wherein the at least one transmitter transmits the non-optical electromagnetic energy characterized by a frequency range such that the returned non-optical electromagnetic energy is characterized by a corresponding return frequency range.

19. The system of claim 18 wherein the return frequency range is substantially the same as the frequency range of the transmitted non-optical electromagnetic energy.

20. The system of claim 16 wherein the processor is further programmed to not store information indicative of the received resonant response in the computer-readable medium if the received resonant response is not discernibly distinct from the resonant responses for which information indicative of the resonant responses has previously been stored in the computer-readable medium.

21. The system of claim 20 wherein the processor is further programmed to cause a written identification to be provided on at least one of the resonant marker or the respective gaming chip for any resonant marker that emits a resonant response that is not discernibly distinct from the resonant responses for which information indicative of the resonant responses has previously been stored in the computer-readable medium.

22. The system of claim 20 wherein the processor is further programmed to assign a respective unique identifier to each of the gaming chips having a resonant marker that emits a respective resonant response that is discernibly distinct from the resonant responses for which information indicative of the resonant responses has previously been stored in the computer-readable medium; and associate the unique identifier with the information indicative of the respective resonant response in the computer-readable medium.

23. The system of claim 16, wherein the processor is further programmed to discard any resonant marker that emits a resonant response that is not discernibly distinct from the resonant responses for which information indicative of the resonant responses has previously been stored in the computer-readable medium.

24. The system of claim 16 wherein the processor is further programmed to discard any one of the gaming chips having a resonant marker that emits a resonant response that is not discernibly distinct from the resonant responses for which information indicative of the resonant responses has previously been stored in the computer-readable medium.

* * * * *